US006592412B1

(12) United States Patent
Geil et al.

(10) Patent No.: US 6,592,412 B1
(45) Date of Patent: Jul. 15, 2003

(54) PROPELLING AND DRIVING SYSTEM FOR BOATS

(75) Inventors: Günter Geil, Bremen (DE); Stefan Hoes, Hamburg (DE); Wolfgang Rzadki, Glinde (DE)

(73) Assignee: Siemens Aktiengesellschaft, Münich (DE)

( * ) Notice: Subject to any disclaimer, the term of this patent is extended or adjusted under 35 U.S.C. 154(b) by 0 days.

(21) Appl. No.: 10/019,901

(22) PCT Filed: Jun. 26, 2000

(86) PCT No.: PCT/DE00/02075

§ 371 (c)(1),
(2), (4) Date: Dec. 21, 2001

(87) PCT Pub. No.: WO01/00485

PCT Pub. Date: Jan. 4, 2001

(30) Foreign Application Priority Data

| | | |
|---|---|---|
| Jun. 24, 1999 | (DE) | 199 28 961 |
| Jan. 14, 2000 | (DE) | 100 01 358 |
| Mar. 10, 2000 | (DE) | 100 11 602 |
| Mar. 10, 2000 | (DE) | 100 11 609 |
| Mar. 10, 2000 | (DE) | 100 11 601 |

(51) Int. Cl.[7] ..... B63H 21/17
(52) U.S. Cl. ..... 440/6; 114/144 E
(58) Field of Search ..... 440/6; 114/144 E, 114/144 RE

(56) References Cited

U.S. PATENT DOCUMENTS

| | | | | |
|---|---|---|---|---|
| 5,417,597 A | | 5/1995 | Levedahl | |
| 5,642,270 A | * | 6/1997 | Green et al. | 363/17 |
| 6,165,031 A | * | 12/2000 | Lonngren et al. | 440/51 |
| 6,179,105 B1 | * | 1/2001 | Haass | 104/DIG. 1 |

FOREIGN PATENT DOCUMENTS

| | | |
|---|---|---|
| CA | 1311657 | 12/1992 |
| DE | 34 26 333 A1 | 1/1986 |
| WO | 97/49605 * | 12/1997 |

OTHER PUBLICATIONS

Siemens, "Siemens–Schottel–Propulsor (SSP) The Podded Electric Drive with Permanently Excited Motor", Mar. 1997, pp. 1–2.
Siemens—Schottel Booklet, The Command Control, Communications and Information System, (1992), pp. 1–2.
Gloel and Graden, Siemens Schottel Propulsor, "Ein Neues Hocheffizientes Antriebssystem", Oct. 1997, pp. 40–44.
"Azipod–Azimuthing electric propulsion drive", (1998), pp. 1–6.
"Austrian river icebreaker with Azipod propulsion", Ship & Boat International, Jun. 1995, pp. 5, 7, 9.
Azipod Propulsion Power, Oct. 1997, pp. 8,9,10,12.
Sonderdruck aus Hansa, (1984), Wartsila—Ein Begriff in Finnland und zunehmend auch in der Welt, pp. 10, 11, 12, 14.
The Motor Ship, (1993), Service proves electric propulsion design, pp. 23–26.

* cited by examiner

*Primary Examiner*—Sherman Basinger
(74) *Attorney, Agent, or Firm*—Schiff Hardin & Waite

(57) ABSTRACT

A propelling and driving system for boats having an outboard rudder propeller. The system provides the boat with reliable and comparatively good maneuverability. The system comprises at least two rudder propellers, each having driving motors configured in the form of a permanent magnet-excited synchronous machine. The stator winding of each synchronous machine has three winding phases connected to a three-phase alternating current, which are connected to the supply system of the boat. A modular controlling and regulating device comprising standardized modules is provided for each of the rudder propellers.

35 Claims, 12 Drawing Sheets

PROPELLING AND DRIVING SYSTEM FOR BOATS

BACKGROUND OF THE INVENTION

1. Field of the Invention

The present invention relates to drive and propulsion systems for ships. In particular, drive and propulsion system having a steering propeller arranged outboard, comprising an azimuth module which can rotate and has a power transmission device, and a propulsion module arranged like a pod on the azimuth module and provided with a drive motor for a propeller.

2. Discussion of the Related Art

A drive technology such as this, which is also known in practice by the expression SSP, is a ship propulsion system which can be rotated, is preferably arranged in the region of the stern of a ship, and at the same time carries out the functions of propulsion, steering and lateral thrust production. The SSP drive is furthermore distinguished by producing little drag on the ship even with the most widely differing ship hull designs, and requires no additional cooling, since this is provided by the water flowing around the drive motor in the propulsion module. Furthermore, the SSP drive has low associated usage and maintenance costs, and offers the advantage of particularly high fuel efficiency.

In the field of ship propulsion technology there is an increasing requirement with regard to the competitiveness of the individual Companies involved to shorten the development times and to reduce the production costs. However, at the same time, propulsion systems are required which can cope with the random failure of one component, so that the maneuverability and controllability of a ship are ensured once again as quickly as possible after a fault occurring in the propulsion system.

Furthermore, it is normal in ship construction for electrical and electromechanical components, such as motors, transformers, switch panels, converter stations, cooling systems or control panels, to be supplied individually by the respective manufacturers to the shipyard, in order then to be installed in the ship by the yard personnel on appropriately provided foundations, and to wired up to one another and for their operation to be tested by the yard personnel. One disadvantage in this case is the considerable logistic complexity and hence considerable cost, which is further increased by the fact that both the manufacture of the individual components and the wiring and testing of the complete system necessitates inspection by a Classification Organization for example the American Bureau of Shipping (ABS), Bureau Veritas (BV), Der Norske Veritas (DNV), Germanischer Lloyd (GL) or Lloyds Register of Shipping (LRS). The present invention is based on the object of providing a drive and propulsion system for ships, which makes it possible to achieve a comparatively high level of safety with regard to reliable maneuverability of a ship, in a comparatively cost-effective manner.

According to the invention, this object is achieved for a drive and propulsion system having the features mentioned above in that at least two steering propellers are provided, whose respective drive motor is in the form of a permanent magnetic synchronous machine, with the stator winding of the synchronous machine having three sections which are connected to a 3-phase alternating current and are connected via the power transmission device to a converter, which is arranged in the ship and is connected on the input side via converter transformers to the ship's on-board power supply system, and in that a control and regulation device, which comprises standardized assemblies in a modular form, is provided for each of the steering propellers.

A drive and propulsion system designed in such a way takes account, to a major extent, of the increasingly more stringent requirements for the reliability and safety of a ship. This is primarily due to the presence of at least two identical steering propellers with an autonomous control and regulation device, which results in homogeneous redundancy in the propulsion system. When a fault event occurs in a mechanical or electrical component of a steering propeller, there is thus at least one spare drive available, which ensures the maneuverability of the ship.

Since the drive motor is in the form of an electrical synchronous machine, a compact, lightweight construction can be achieved, as is required for arranging the drive motor in the propulsion module. The interconnection of the sections of the stator winding, as well as the converters and converter transformers, result in a three-phase synchronous motor which is operated from the ship's on-board power supply network, and which makes it possible to achieve an adequate rated rotation speed and a sufficiently high torque at the propeller for the most common ship propulsion system in the power range from 5 W to 30 MW. Furthermore, the modular construction of the control and regulation device, which is composed of standardized modules, contributes to relatively cost-effective production.

In one preferred refinement of the invention, the converter is a network-controlled 12-pulse direct converter, and is connected on its input side to the on-board 3-power supply network via three converter transformers in the form of 3-winding transformers. Firstly, a direct converter can be manufactured cost-effectively and, secondly, it is particularly suitable for operation of large three-phase motors at a low rotation speed, such as those required for ship propulsion systems.

In order to achieve the abovementioned object, the invention furthermore proposes, for a drive and propulsion system of the type mentioned initially, that the drive motor be in the form of a permanent magnet synchronous machine, with the stator winding of the synchronous machine having six sections, of which three are in each case connected to a 3-phase alternating current and, forming a subsystem, are connected via the power transmission device to a converter which is arranged on the ship and is connected on the input side via a converter transformer to the ship's on-board power supply network, and in that a control and regulation device, which comprises standardized assemblies in a modular form, is provided for each of the two subsystems.

Such a drive and propulsion system also takes account of the random failure of one component and is easy to produce economically, for the reasons mentioned above. The partial redundancy of the drive system resulting from there being only a single steering propeller in this case is achieved by means of the autonomous subsystems, which ensure that at least limited propulsion is maintained for the ship when a defect occurs.

Ship propulsion systems, in particular steering propeller propulsion systems, produce oscillations during operation which propagate through the entire ship's hull and cause vibration in it. While, in the case of diesel propulsion systems, these oscillations are caused primarily by the reciprocating pistons, it might be supposed that such oscillations would no longer occur in the case of electric motors, such as those used in particular in submarines, but which are also being increasingly used for surface ships. However, this is not the case since, in particular, even a ship's propeller represents an oscillating load for the propulsion system, to be precise because the propeller blades partly move along the skeg or propeller-shaft stay (which is fitted to the ship's hull) during their rotational movement but, in contrast, can move largely free from this stay during another part of their rotational movement. This fluctuating load torque is readjusted by the rotation speed regulator, or by the current regulator which is subordinate to it, in order to stabilize the rotation speed of the ship's screw as exactly as possible at the pre-selected rotation speed nominal value. In this case, the torque (which fluctuates at the shaft rotation speed gas multiplied by the number of blades on the propeller) is transmitted to the drive motor, and is transmitted via its housing to its anchorage, and hence to the ship's hull. Parts of the ship's structure are thus caused to oscillate at the fundamental frequency of this pulsating torque and, owing to the mechanical characteristics, the resonance of the ship's hull is not negligible at the relevant frequency. The vibration resulting from this not only causes stress to the ship's crew but also results in a considerable load on the entire structure of the ship, and should thus be avoided. The only known way to do this is to calculate the weak points for such oscillations using the so-called finite element method, and to strengthen the critical areas determined in this way by adding additional tons of steel. This method is on the one hand expensive while, on the other hand, it reduces the maximum permissible cargo weight in the ship, increases the fuel consumption and, furthermore, although it may reduce the material-destructive effects of the oscillations produced by the propulsion system, cannot, however, eliminate the cause.

Hydrodynamically speaking, the load on the ship's propeller is described by its wake field. The fluctuation in this load, which is caused by the skeg or propeller-shaft stay fitted to the ship's hull, is once again evident in the inhomogeneity of the wake field of the propeller which, in turn, is evident in a fluctuating angle of advance during revolution of the propeller blade. Rotation speed control which keeps the rotation speed of the ship's propeller stabilized as exactly as possible at the pre-selected rotation speed nominal value has the negative effect that the inhomogeneity of the wake field fully reflects the fluctuation in the angle of advance of the propeller. Any fluctuation in the angle of advance of the propeller reduces the cavitation safety margin of a propeller since, in this case, the operating point of a propeller approaches or exceeds its cavitation limit. Particularly in the region of a skeg or propeller-shaft stay fitted to the ship's hull, the operating point of the propeller can reach or exceed the cavitation limit, thus initiating cavitation which can then cause considerable damage to the ship and, in particular, to the propeller. Cavitation also leads to unacceptable pressure fluctuations and noise which, in particular, considerably reduces the operational value of passenger, research and military ships.

The disadvantages of the described prior art have resulted in the problem which led to the initiation of the invention of providing a possible way in which the oscillations on the anchorage of a propulsion system, in particular of an entire ship's hull including the inhomogeneous wake field of a ship's propeller, which are caused by driving a load at a controlled rotation speed and with a fluctuating torque, in particular in the case of a ship's propeller, can be reduced as far as possible, or can even be avoided.

In order to solve this problem, the invention provides, for the drive and propulsion system, for the regulation device for damping the oscillations in a drive whose rotation speed is regulated to be only a single rotation speed regulator irrespective of the number of motors operating on one shaft, with the output signal from the rotation speed regulator being fed back to its regulator input. Since the output signal from the rotation speed regulator is approximately proportional to the torque emitted from the drive, then it is possible to achieve a certain amount of insensitivity to torque fluctuations when this output signal is applied, with a suitable phase, to the rotation speed actual value.

It is recommended that the fluctuations in the regulator output signal, which are proportional to the torque, be supplied phase-shifted through approximately 180° to the rotation speed regulator input so that, firstly, this results in negative, and hence stable, feedback and, secondly, the torque required to compensate for the load-dependent fluctuations in the rotation speed, and the regulator output signal which is approximately proportional to it, are reduced. In particular, this means that the fluctuations in the drive torque can be reduced considerably, as a result of which the torque fluctuations emitted to the ship's hull via the anchorage, and the pressure fluctuations transmitted via the ship's propeller to the ship's propeller wake field can be reduced to non-critical values. One side effect in this case is that the rotation speed of the propeller does not remain exactly constant, but is subject to certain fluctuations, caused by the changing load. However, this is of very minor importance for the forward propulsion produced by the propeller. On the other hand, this advantageously allows the moment of inertia of the rotor of the electric motor, of the propeller and of the shaft to be used to damp these oscillations. Since the shaft is mounted such that it rotates with a virtually no friction, the ship's hull is not excited by these rotation speed fluctuations.

Speaking hydromechanically, this effect has the major advantage that the rotation speed of the propeller does not remain exactly constant, but is subject to certain fluctuations which are caused by the changing loads on the propeller; this reduces the fluctuation width caused by the hydromechanically coupling between the wake field and the angle of advance. This reduction in the fluctuation width of the angle of advance results from the fact that the fluctuation in the load on the propeller blade located in the inhomogeneous wake field of the skeg or propeller-shaft stay fitted to the ship's hull leads, owing to the above effect of the invention, to a change in the rotation speed whose direction and magnitude counteract its cause, thus leading to damping of the fluctuation width of the angle of advance of that propeller blade which is most at risk of cavitation. The reaction of this propeller blade on the other blades of the propeller resulting from the described effect is of minor importance, since their operating points remain considerably closer to the rated operating point of the propeller than the operating point of that propeller blade which is located in the inhomogeneous wake field of the skeg or propeller-shaft stay which is fitted to the ship's hull.

It is within the scope of the present invention for the output signal fed back from the rotation speed regulator to be multiplied by a factor. This feedback should, of course, be chosen such that it is not too strong, since, otherwise, the approximately constant mean value of the drive torque, which is likewise fed back, would result in major reduction in the rotation speed nominal value, and on implementation of the rotation speed regulator, having a PI characteristic, would itself no longer be able to accelerate the propulsion shaft to the selected rotation speed nominal value. Since, on the other hand, a predetermined voltage range, for example −10 V to +10 V, is available both for the regulator input signal and for its output signal, in which case the limit values respectively correspond to the maximum rotation speed for traveling ahead and traveling astern, or to the maximum motor torque, multiplicative matching of these two signal levels is essential for selecting an optimum amount of feedback.

A development of this idea of the invention provides for the multiplication factor to be between 0.01% and 3%, preferably between 0.1% and 2.0%, and, in particular, between 0.15% and 1.5%. This is intrinsically a very low level of feedback since—as already mentioned above—the majority of the power required by the alternating load can be taken from the moment of inertia of the rotor of the electric motor, of the propeller and of the propulsion shaft, and can in each case be fed back to them once again. Since the invention provides a certain degree of freedom for rotation speed fluctuations in this case, the propulsion train can advantageously be used as an energy store which, in a similar way to the energy-storage capacitor in an electrical power supply, contributes to the smoothing of the power consumption from the electrical supply network for the propulsion system. A small amount of feedback here therefore leads to the noteworthy result that the torque to be applied by the drive motor is largely smoothed, without this causing any significant, permanent control error from the pre-selected nominal value.

With regard to the design selection of the level of feedback according to the invention, such a setting has been proven at which the steady-state control error is between approximately 0.2% and 1.5% at the rated load. In a case such as this, despite the negative feedback of the regulator output signal, the quality of the control system, in particular the dynamic response to changes in the rotation speed nominal value, is not adversely affected.

The invention also provides for the steady-state control error to be compensated for by a corrected nominal value. Since the steady-state control error in the control loop structure according to the invention is calculable, then it can be largely compensated for by means of a correction circuit.

One compensation method that is preferred by the invention uses the estimated, mean load on the drive as an output variable and attempts, by mathematical calculation of the control system parameters from this, to determine the steady-state control error to be expected, and to compensate for this by means of appropriate adjustment of the rotation speed nominal value in the opposite sense.

In the case of propeller propulsion systems for ships, the control system has at least approximately known characteristics, and in particular, the steady-state mean load torque is obtained from the steady-state rotation speed actual value in accordance with a characteristic. For propeller propulsion systems, the drive torque in this case rises approximately with the square of the rotation speed actual value. Thus, if the rotation speed actual value is intended to correspond to a specific WCSA rotation speed nominal value, then it is possible to use this characteristic to approximately determine the torque which is approximately proportional to the regulator output signal in the steady state, so that the mean value of the fed back signal, and hence the residual control error, can also be determined. Since, in a case such as this, this is added to the (ideal) nominal value, preferably additively, then the ideal rotation speed nominal value actually corresponds precisely with the occurrence of the already calculated control error as the rotation speed actual value.

In accordance with the idea of the present invention, the rotation speed regulator may have a PI characteristic. In the steady state, this results in the steady-state rotation speed actual value being extremely stable, and largely matching the ideal rotation speed nominal value thanks to the prior distortion according to the invention.

Although the control system according to the invention can be used for virtually all propulsion shafts with approximately cyclically fluctuating load torques, one very particularly important, and hence preferred field of use, is the control of an electrical propeller propulsion system for surface ship or submarines. In particular, in conjunction with the drive and propulsion system according to the present invention, since the characteristics of the propeller result in severe torque fluctuations and, secondly, the cyclic variations in the drive torque to be applied by a motor for stabilization cannot actually, in the case of ships, be introduced into an anchorage component which is immovably fixed on a base, since they are invariably introduced into the moving ship's hull.

The output from the rotation speed regulator of corresponding control devices for drive and propulsion systems is the nominal value of a current regulator for the converter and must not vary more rapidly than the on-board power supply network for the propulsion device for the ship's propeller can follow dynamically. The dynamic limits for load changes in the on-board power supply network depend on diesel generators in the diesel generator system. In this case, the diesel engine and the generator in the diesel generator system, which is normally in the form of a synchronous generator, can be considered separately from one another. When designing the load response of diesel engines for diesel generator systems in ships, it is necessary to comply with the requirements of the International Association of Classification Societies (IACS). The three-stage load change diagram described there has a considerable effect, with present-day highly boosted diesel engines, on the dynamic response of the drive and propulsion system for ships propellers, in particular steering propellers. A further exasperating factor is that the values quoted there are often no longer satisfied these days, owing to lack of adequate maintenance, particularly in the upper power region. The feasible dynamic response for the power output on the diesel engine shaft therefore decreases, from experience, when the ship has been at sea for a lengthy time.

A further time gradient of the power output from diesel engines, which is not specified in a generally applicable manner by IACS or elsewhere, depends on the thermal load capacity of the diesel engines. A uniform load change on a warmed-up diesel engine from 0% to 100% rated power or from 100% rated power to 0% must be carried out in only a minimum time which is highly dependent on the physical size of the respective diesel engine. This time gradient must not be exceeded, even in places, since otherwise, the diesel engine may be damaged. These minimum times explained above may be between 10 seconds for small sizes, and 60 seconds for large sizes.

Converters with a control wattless component, for example current intermediate circuit converters, direct converters, converters for DC machines and the like, require a load-dependent wattless component. This wattless component is supplied by the field for the synchronous generators in the diesel generator system. The time gradient of the load-dependent wattless component from the converters mentioned above with a control wattless component is approximately 15 to 25 times faster for propulsion devices for ship's propellers than can be followed by the field of the synchronous generators in the diesel generator system.

If the propulsion system for ship's propellers exceed the dynamic limits of the diesel engines in the diesel generator system, the frequency of the on-board power supply network supplied by the diesel generator system fluctuates to unacceptable extents. It is also possible for the diesel engines to be damaged, since the rotation speed control for the diesel generator system must keep the frequency of the on-board power supply network within a permissible range irrespective of the dynamic limits. If the dynamic limits of the synchronous generators in the diesel generator system are exceeded, the voltage of the on-board power supply network fluctuates unacceptably.

Thus in the past, test journeys were carried out experimentally based on varying run-up times for the rotation speed nominal value and/or on current nominal value in a number of steps or continuously until the propulsion device for the ship's propeller could be operated satisfactorily in the on-board power supply network that was supplied with electrical power by the diesel generator system. In this case, it was often only possible to optimize specific operating points. There was no fixed relationship between the adjustment capabilities in the control system for the electrical propeller motor and their dynamic effects on the diesel generator system in the on-board power supply network. The time profile for reducing the load on the diesel generator system was rarely taken into account, or adjustable, in the control system for the propulsion device for the ship's propeller.

For the purposes of the present invention, a diesel engine is used to represent internal combustion engines as a drive motor for a synchronous generator. However, internal combustion engines may also be used which are operated using diesel, marine diesel, heavy oil etc., and steam turbines or gas turbines may also be used as drive engines. If the drive engine is a steam turbine or gas turbine, the IACS load change diagrams are inapplicable, and the time gradient of the load output is in a different range, which means that times which differ from those quoted are applicable to the run-up and run-down times of the adaptive ramp transmitter for the current nominal value of the current regulator.

If the run-up and run-down times for the adaptive ramp transmitter for the current nominal value of the current regulator can be varied in proportion to the magnitude of the actual rotation speed of the electric propeller motor, this ensures that the run-up and run-down times for the ramp transmitter for the current nominal value are based on the maximum permissible rate at which the diesel engines in the diesel generator system which supply the on-board power supply network with electrical power can have loads applied to them and removed from them. This means that the real power consumed by a converter associated with the drive device for the ship propeller has a run-up and run-down time which is independent of the rotation speed of the electrical propeller motor.

A minimum run-up and a minimum run-down time are preferably predetermined for the run-up time and the run-down time of the adaptive ramp transmitter for the current nominal value of the current regulator in a lower rotation speed range of the electric propeller motor or of the ship's propeller, which are dependent on the maximum permissible rate of change of the wattless component emitted by synchronous generators in the diesel generator system which feeds the on-board power supply network.

If the run-up and run-down times of the adaptive ramp transmitter for the current nominal value of the current regulator can be changed in inverse proportion to the number of diesel generators in the diesel generator system which supply electrical power to the on-board power supply network, this means that the real power consumed from a diesel generator in the diesel generator system has a run-up and run-down time which is independent of the operation of the converter associated with the drive device for the ship's propeller.

In one expedient refinement of the drive device for ship's propellers according to the invention, the run-up and run-down times of the adaptive ramp transmitter for the current nominal value of the current regulator can be varied as a function of the operating state of the diesel generator system which supplies electrical power to the on-board power supply network, in which case different diesel generators in the diesel generator system may be used in different operating states.

If the output value from the rotation speed regulator corresponding to the nominal rotation speed can be entered both directly in the current regulator of the converter for the electric propeller motor and in the adaptive ramp transmitter, whose output value can be entered via a positive offset step in an upper current value limiting unit for the rotation speed regulator and, via a negative offset step, into a lower current value limiting unit for the rotation speed regulator, this means that the rotation speed regulator can control the current nominal value to be passed onto the current regulator without any limits when it is in the stabilized state. Otherwise, considerable beat frequencies would occur in the electric propeller motor, and these would appear as mechanical oscillations or structure-borne sound sources in the ship, in particular, there would be a risk of the ship's propeller starting to cavitate, which in turn could lead to damage to the ship's propeller and to the ship. In the procedure described above, the output of the adaptive ramp transmitter maps the maximum permissible dynamic response of the diesel generators explained and described above. The positive and negative offset steps of the adaptive ramp transmitter and the upper and the lower current value limiting units for the rotation speed regulator are used to provide the required rotation speed control freedom. It is thus possible for the rotation speed regulator to control the current nominal value, which is to be passed on to the current regulator for the converter, via a "moving window", within which the rotation speed regulator is free in terms of rotation speed control.

Within this moving window, the rotation speed regulator operates with its full dynamic range. This thus leads to voltage fluctuations in the on-board power supply network, since the excitation for the synchronous generators in the diesel generator system can no longer follow the rate of change of the current nominal value. The reactive current on the on-board power supply network side from the converter for the drive device for the ship's propeller produces these voltages fluctuations via the reactance of the generator. The magnitude of the offset in the positive offset step and negative offset step, and hence the variation width and the magnitude of the moving window are set such that any on-board power supply network side reactive current resulting therefrom produces, across the reactance of a synchronous generator in the diesel generator system, a voltage drop which is within the maximum permissible voltage tolerance of the on-board power supply network. In consequence, no disturbances occur, since rapid voltage fluctuations within the maximum permissible voltage tolerance are not critical in the on-board power supply network. In this case, the magnitude of the offset is a function of the rotation speed, with the on-board power supply network side power factor being dependent on the drive level of the converter associated with the drive device for the ship's propeller.

The magnitude of the offset is proportional to the number of diesel generators which are feeding electrical power to the on-board power supply network, since the short-circuit rating Sk" in the on-board power supply network is likewise approximately proportional to the number of diesel generators producing the supply.

When the actual rotation speeds of the ship's propeller or of the electrical propeller motor rise, their dynamic response changes considerably. The dynamic response of the ship's propeller decreases more than proportionally as the actual rotation speeds rise, on the basis of the family of propeller curves (towing curves-free drive curve).

In the case of drive and propulsion systems for ships that are known from the prior art, the regulation device comprises a rotation speed regulator with which the electric propeller motor is associated and whose output signal, the torque nominal value or current nominal value, regulates the rotation speed of the electric propeller motor via a converter, and a ramp transmitter, in which a rotation speed nominal value for the electric propeller motor can be entered and by means of which a rotation speed nominal value profile can be preset for the rotation speed regulator, by means of which the actual rotation speed of the electric propeller motor can be matched to the rotation speed nominal value for the electric propeller motor as entered in the ramp transmitter. In this case, the run-up time preset by the ramp transmitter by means of the nominal value preset, is increased in one to three steps as the rotation speed of the electric propeller motor rises, in order to match the drive device to the ship's propeller curve.

This conventional configuration of the matching of the drive device to the ship's propeller curve has considerable disadvantages. Starting from a rotation speed of 0, the electric propeller motor in the drive and propulsion system initially accelerates optimally. The power of the electric propeller motor then rises ever faster during a run-up process with a constant run-up time, until a current limit on the output side of the rotation speed regulator allows the power to be increased further only at a low rate.

If the run-up time is then switched during the transition from one stage to the next stage, the acceleration power provided by the electric propeller motor in the drive and propulsion system decreases to approximately 0. The power from the electric propeller motor in the drive and propulsion system now in this stage rises again during the further run-up with a constant run-up time, although this is now longer, as described above. In this way, the electric propeller motor in the drive and propulsion system pumps the power required for acceleration of the ship's propeller out of the ship's on-board power supply network. This has the unpleasant effect for ship control that the drive and propulsion system drops into a hole when accelerating over certain rotation speed ranges, and effectively stops. Furthermore, the power demand pumped by the drive and propulsion system from the ship's on-board power supply network is therefore also undesirable, since it necessitates an unnecessary power margin in the on-board power supply network.

The current limit for the electric propeller motor in the drive and propulsion system for ships propellers of this generic type and as described above occurs, when calculated roughly, at about ⅓ of the rated torque over the respective ship's propeller curve. The range between the current limit for the electric propeller motor and the calculated ship's propeller curve is required to ensure that there is also a margin for heavy seas and/or ship maneuvering in addition to the acceleration torques required for ship acceleration processes. The ramp transmitters used in the past for drive devices for ship's propellers which were controlled in steps are unable to assign a defined acceleration torque to the electric propeller motor during acceleration processes and, in fact, they simply produce only the respective current limits appropriate at that time over wide rotation speed ranges of the electric propeller motor. This is because the ship's acceleration time is several times the run-up time for this type of ramp transmitter.

The invention is thus also based on the object of developing the drive and propulsion system for ships mentioned initially such that the ship propeller can be accelerated more uniformly by means of the electric propeller motor for the drive device, without any current limit. Furthermore, the configuration according to the invention is intended to ensure that the power required for acceleration processes for the ship's propeller is produced at the respectively desired level by the electric propeller motor, with the aim being to reduce or avoid unnecessary spare power capacities in the ship's on-board power supply network.

According to the invention, this object is achieved by the ramp transmitter being in the form of an adaptive ramp transmitter and having a characteristic transmitter which can be controlled by the magnitude of the rotation speed actual value of the electric propeller motor. The adaptive ramp transmitter and its characteristic transmitter provide the capability for the drive and propulsion system according to the invention for ships to produce a definable acceleration torque in addition to a steady-state load torque for the electric propeller motor. Particularly when the actual rotation speeds of the electric propeller motor are relatively high, this definable acceleration torque can to a certain extent be kept constant, which means that no unnecessary high acceleration torque values occur, even at times. Interaction with active oscillation damping, which is not described here, and readjustment of the ramp transmitter also allows, inter-alia, the tendency of a ship's propeller to cavitate or to produce bubbles to be reduced or suppressed. This applies even during extreme ship maneuvers.

In order to match the adaptive response of the drive and propulsion system according to the invention to the operator characteristics of the electric propeller motor and of the ship's propeller, it is advantageous to be able to preset different dependency levels between the actual rotation speed of the electric propeller motor and the run-up time in the characteristic transmitter of the adaptive ramp transmitter for different actual rotation speed ranges of the electric propeller motor.

In order to make it possible to optimize the drive and propulsion system according to the present invention for ships in terms of the various target functions, for example minimum fuel consumption, minimum time passing, high maneuvering capability for the ship etc., it is advantageous to set the dependency level between the actual rotation speed of the electric propeller motor and the run-up time preferably continuously, at least when the electric propeller motor is operating in a relatively high actual rotation speed range.

In order to ensure that the electric propeller motor, and hence the ship's propeller, can operate in a maneuvering range with a wide dynamic range, defined comparatively low actual rotation speeds, it is advantageous if it is possible to preset a constant, short run-up time in the characteristic transmitter of the adaptive ramp transmitter when the electric propeller motor is in a low actual rotation speed range, for example between 0 and ⅓ of the rated rotation speed.

In order to ensure uniform acceleration of the ship's propeller, largely free of any current limit, by the electric propeller motor in a comparatively high actual rotation speed range, it is expedient to be able to preset a run-up time which rises sharply as the actual rotation speed of the electric propeller motor rises in the characteristic transmitter of the adaptive ramp transmitter when the electric propeller motor is in a high rotation speed range, for example between ½ of the rated rotation speed and the rated rotation speed. The characteristic transmitter thus effectively then associates a run-up time with each rotation speed actual value in this relatively high actual rotation speed range.

In order to ensure that the drive and propulsion system according to the invention makes a smooth transition between the comparatively low actual rotation speed range and the comparatively high actual rotation speed range of the electric propeller motor, it is advantageous to be able to preset a run-up time which rises less sharply than the high actual rotation speed range, as the actual rotation speed of the electric propeller motor rises, in the characteristic transmitter of the adaptive ramp transmitter for a medium actual rotation speed range of the electric propeller motor which is between the low and the high actual rotation speed ranges, for example between ⅓ of the rated rotation speed and ½ of the rated rotation speed.

During normal operation of the ship, a characteristic which is stored in the characteristic transmitter is used which has been deliberately selected as a compromise between adequate ship maneuvering characteristics and a method of operation which protects the entire machine system. In order to increase the maneuverability of the ship to a major extent in an emergency, it is advantageous for the adaptive ramp transmitter to be connected to an input unit, by means of which the run-up times predetermined in the characteristic transmitter can be set to minimum values, excluding any consideration of technically dependent limit values.

SUMMARY OF THE INVENTION

According to one advantageous development of the present invention, each one of several converters is connected to a network-controlled 6-pulse direct converter and, on its input side, is connected to the on-board power supply network via a converter transformer in the form of a 4-winding transformer. If the primary windings of the two converter transformers are in this case expediently arranged offset through 30° with respect to one another, this results in the two subsystems having a 12-pulse network reaction on the ship's on-board power supply network.

It is particularly advantageous if both subsystems can be operated in parallel, in which case one of the regulation and control devices of the subsystems can be used as the master, and the other can be used as a slave. Parallel operation of the two subsystems firstly results in active redundancy in the propulsion system while, secondly, the master-slave arrangement of the regulation and control devices ensures higher-level control of both subsystems. This makes it possible for certain tasks, such as rotation speed regulation, to be carried out exclusively by the regulation and control device that is used as the master, and for it to be impossible for these tasks to be carried out by that which is used as a slave.

It is furthermore advantageous for each subsystem to have an associated programmable safety device which, in addition to alarm signals, also produces regulation and control signals automatically. Such regulation and control signals make it possible, for example, to reduce the motor rotation speed or the stator current without any delay when a defect is detected in one of the subsystems.

According to a further feature of the invention, each converter has phase current regulation. This offers the advantage that the current at a variable frequency can be applied to the synchronous machine. According to a further feature of the invention, the phase current regulation is preceded by field-oriented regulation in the form of transvector control, in order to give the propulsion system a good dynamic response. The object of the transvector control in this case is to determine the orientation of the magnetic flux from the actual values of the stator voltage, stator currents and rotor position of the synchronous machine, with the nominal value of the torque-forming stator current being preset at right angles to the flux axis that is determined.

One development of the present invention furthermore provides a monitoring device, by which the power generation and distribution in an on-board power supply network can be protected against being overloaded by the drive motor. This ensures that the nominal value of the rotation speed is restricted when the propeller power required by the predetermined nominal value exceeds the available electrical power in the ship's on-board power supply network. Furthermore, in the event of defects in the on-board power supply network, it is possible to preset a different nominal value, in order to avoid overloading of the power generation equipment, and hence a "blackout" in the on-board power supply network.

According to a further preferred refinement of the invention, the individual components of the drive and propulsion system are arranged in at least one prefabricated container. In this context, the term container means a virtually autonomous functional unit which is provided with interfaces to other ship systems, for example the control system. This offers the capability to connect the propulsion system, and to check its operation, largely independently of its location in the ship. After being dispatched to the shipyard, all that is then necessary is to mount the container on a predetermined foundation in the ship, and to connect it to its power and control system. Since there is thus no need to connect the individual components of the propulsion system in the shipyard, there is no need either for logistic support for the individual components in the shipyard, thus resulting in simpler and clearer logistic planning. Furthermore, this allows flexible delivery and hence installation of the container to be achieved at an optimum time. The use of a single foundation for the container rather than separate foundations for the individual components also ensures that the manufacturing complexity is reduced, and is hence more cost-effective.

In order to allow a prefabricated container to be transported to the shipyard using conventional container ships, the present invention provides that the dimensions of the containers be standardized.

According to a further advantageous proposal of the present invention, a unit for remote position monitoring is arranged on the container. This may preferably be a GPS system. This makes it possible to use the GPS system to determine the exact location of a container. It is thus possible to check the movement of the container from the loading point via the transport to the destination. Existing GPS systems, for example, can be used for this purpose, for example the IN MAR SAT system which is already used for maritime purposes. This refinement makes it possible in a simple manner to ensure that the corresponding containers are sent by the correct route to the correct destination. This configuration of the GPS units as removable units on the container, for example units comprising a transmitter, power supply and the like, allows the unit to be removed from the container, and to be reused, once the container has arrived at the correct location.

The invention is furthermore based on the object of developing the initially mentioned drive and propulsion system such that the electric propeller motor can be accelerated, decelerated or electrically braked without any risk of problems, caused by fast load changes, in the on-board power supply network or in the area of the diesel generator system.

According to the present invention, this object is achieved by an adaptive ramp transmitter, by which time matching of the current nominal value of a current regulator of the converter to the current nominal value corresponding to the nominal rotation speed present at the rotation speed regulator, can be controlled. This takes into account limit values predetermined by the on-board power supply network and/or by the diesel generator system which feeds the on-board power supply network with electrical power.

BRIEF DESCRIPTION OF THE DRAWINGS

Further details, features and advantages of the subject matters of the present invention can be found in the following description of preferred exemplary embodiments. In the associated drawings, in detail.

DETAILED DESCRIPTION OF THE PRESENTLY PREFERRED EMBODIMENTS

Figure 1:
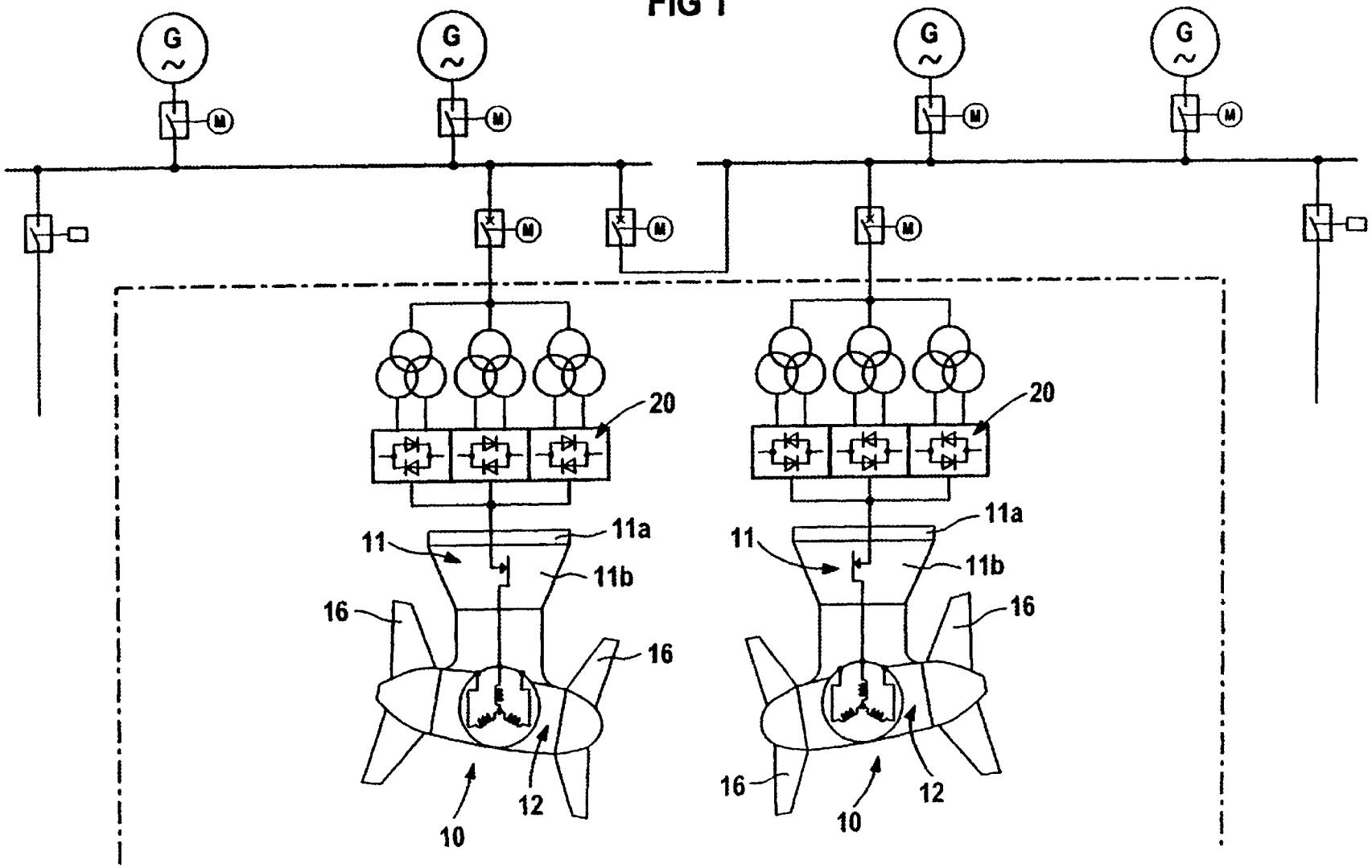
FIG. 1 shows a schematic illustration of a drive and propulsion system with homogeneous redundancy.
Figure 2:
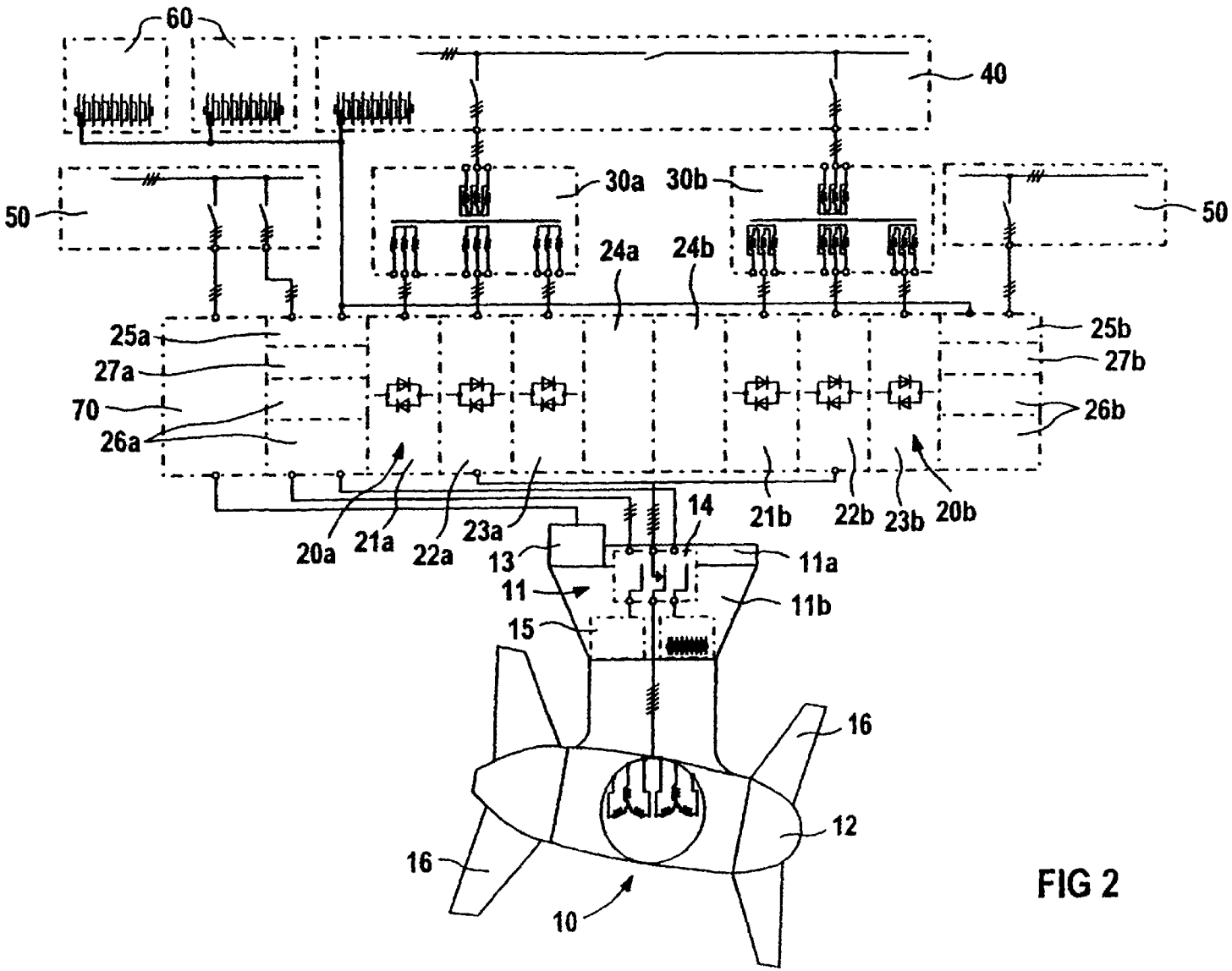
FIG. 2 shows a schematic illustration of a drive and propulsion system with partial redundancy.

Exemplary embodiment drive and propulsion systems are shown in FIGS. 1 and 2. Each embodiment has a steering propeller 10, comprising an azimuth module 11 and a propulsion module 12, which is fitted to it like a pod. The azimuth module 11 can be connected via a fixed part 11*a* to the hull of a ship. An azimuth drive 13 is arranged in the fixed part 11*a* of the azimuth module 11, is controlled by an azimuth controller 70, which is located in the ship, and drives a part 11*b* of the azimuth module 11 which can rotate.

Furthermore, a power transmission device 14 is arranged in the fixed part 11*a* of the azimuth module 11 and connects a drive motor, located in the propulsion module 12, to the ship's on-board power supply network. The part 11*b* of the azimuth module 11 which can rotate has auxiliary functions, for example for electrical supply or control. The drive motor arranged in the propulsion module 12 is in the form of a permanent magnet synchronous machine and drives two propellers 16.

There are two identical steering propellers 10 in the exemplary embodiment shown in FIG. 1. The stator winding of the synchronous machine has three sections, which are connected to a 3-phase alternating current and are connected via the power transmission device 14 to a direct converter 20, which is arranged in the ship and converts the electrical power in the 3-phase alternating current to an alternating current at a specific voltage and frequency, and with a specific number of phases. The direct converter 20 is used to vary the rotation speed of the drive motor, and is connected to the on-board power supply network on its input side via three 3-winding transformers.

The drive system illustrated in FIG. 1 has a propulsion redundancy level RP of 50%. This homogeneous redundancy means that the drive system is available in one of the steering propellers 10 even when a fault event occurs, and the ship is thus maneuverable at any time, which is particularly important in poor weather conditions.

The drive and propulsion system shown in FIG. 2 has partial redundancy and thus likewise satisfies the safety requirements of the Classification Organizations, such as Germanischen Lloyd. If a propulsion system is equipped with only one drive motor and the ship has no further propulsion system, they require this system to be designed such that at least restricted propulsion operation remains after a defect in the converter or in the regulation and control.

The above mentioned requirement is satisfied by the drive and propulsion system shown in FIG. 2 in that the steering propeller 10 is provided with a drive motor in the form of a permanent magnet synchronous machine, whose stator winding has six sections, three of which are in each case connected to a 3-phase alternating current, and are connected via the power transmission device 14 to a converter 20*a*, 20*b* arranged on the ship. The converters 20*a*, 20*b* are each in the form of network-controlled 6-pulse direct converters, and are each connected on their input side, via a converter transformer 30*a*, 30*b* in the form of a 4-winding transformer, to a medium-voltage switchgear assembly 40 for the ship's on-board power supply network. The direct converters 20*a*, 20*b* are each composed of a group of three power semiconductors 21*a*, 21*b*, 22*a*, 22*b*, 23*a*, 23*b* connected back-to-back in parallel, and for each of which a cooling system 24*a*, 24*b* is provided.

The subsystems formed in this way each have their own associated regulation and control device 25*a*, 25*b*, 26*a*, 26*b*, which are each connected to a low-voltage switchgear assembly 50 for the ship's on-board power supply network, as can be seen in FIG. 2. Each subsystem furthermore has an associated programmable logic safety device 27*a*, 27*b*, by means of which both alarm and regulation and control signals can be produced. A monitoring device 60 is used to monitor the power generation and distribution in the on-board power supply network.

During normal operation, the two subsystems are operated in parallel. The regulation and control device 25*a*, 26*a* for the first subsystem is in this case used as the master, while the device 25*b*, 26*b* for the other subsystem acts as a slave. The master and slave can in this case be interchanged only with the drive system switched off. While the regulation and control devices 25*a*, 25*b*, 26*a*, 26*b* for the two subsystems detect their respective actual values, for example the voltage and current, independently of one another, only the regulation and control device 25*a*, 26*a* which is used as the master is responsible, by virtue of its superior position, for functions such as power generation protection, rotation speed control, transvector control, or pulse formation for the power semiconductors, in both subsystems. The control and regulation device 25*b*, 26*b* which is used as a slave, is inhibited from carrying out these functions.

If a fault occurs in one of the two subsystems, then the faulty subsystem is disconnected on the input side from the on-board power supply network by means of a circuit breaker in the medium-voltage switchgear assembly 40, and is disconnected on the output side from the drive motor for the propeller 16 by means of an isolating switch in the output of the direct converters 20*a*, 20*b*. Once the faulty subsystem has been grounded, it is accessible for maintenance. The other, fault-free subsystem provides restricted propulsion operation, with its control and regulation device 25*a*, 25*b*, 26*a*, 26*b* in this case being used as the master.

The above drive and propulsion system is arranged in containers that are in the form of prefabricated functional units. A container arranged on an appropriate ship foundation can contain the following components:

direct converter power section, deionized water cooling system, direct converter, direct converter control, ship-specific control and regulation devices 25*a* to 26*b*, power supply cabinet, converter transformers 30*a*, 30*b* fresh-water cooler for converter transformers 30*a*, 30*b* hydraulic pump drives, control cabinet, azimuth control.

These components are supplied by the respective manufacturers to the container installation location, and are connected to one another to form a functional unit. This simplifies the interface declaration with the shipyard. The above containers now have only interfaces to the ship system, for example a connection to the supply and exhaust air system and to the ship air conditioning system, a connection to the fresh cooling water system in the ship, a connection for the power cables to the medium-voltage switchgear assembly, a connection for the auxiliary power supply for the low-voltage main switch panel and emergency switch panel, a connection for the signal and bus lines or a connection for the lighting and plug socket cables, and interfaces to the SSP propulsor, for example a connection for the hydraulic lines to the azimuth motors, a connection for the power cables to the SSP propulsor, a connection for the cables for the auxiliary power supply or a connection for the signal and bus lines, preferably by means of a ring bus system.

However, not only can the drive and propulsion system be combined in one or more containers, but it can also be provided in the engine control room, in which the medium and low-voltage units as well as the engine control room control station and automation units can normally be found, or a power generator unit having a synchronous generator and a diesel engine or a gas turbine as the drive.

The container which is used as a prefabricated system module is in the form of a welded structure, and its dimensions are standardized for transportation using container ships. The container is in this case preferably a so-called standardized 20-foot foot container with a length of 6.055 m, a width of 2.435 m and a height of 2.591 m, or a 40-foot container with a length of 12.190 m, a width of 2.435 m and a height of 2.591 m. Electrical machine rooms of different size can in this way be constructed in the ship by joining a number of containers together in the longitudinal and/or transverse directions. For this purpose, the prefabricated containers are normally inserted into the ship frame system. This ensures relatively simple disassembly, for example for servicing and maintenance purposes.

Figure 11:
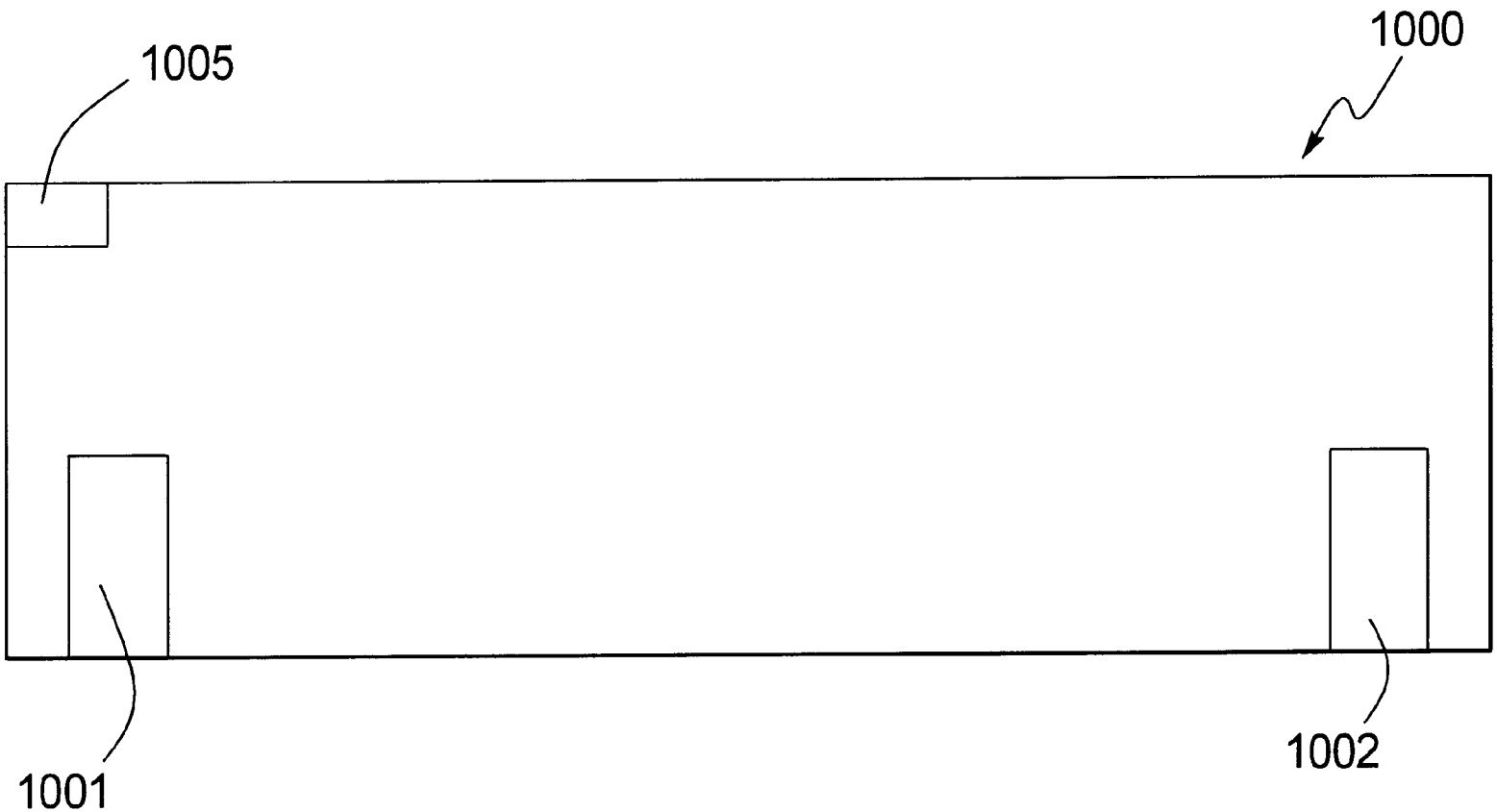
FIG. 11 is an elevational view of a container for transporting the components of the drive and propulsion system.

With regard to the latter, the containers, such as 1000 (see FIG. 11), have lockable doors 1001, 1002 which make them accessible to specialist personnel. In addition, during shipping to the shipyard, the container 1000 can have a removable remote position monitor, such as a GPS unit 1005.

In addition, a container is generally equipped with lighting and plug sockets and has a connection to the ship supply and exhaust air system or, alternatively, to the ship air conditioning system. A heat exchanger, which is connected to the ship fresh water system, is generally provided for the heat losses from the components arranged in the container but cannot be dissipated from the container area via the exhaust air system. Since a ship is normally subject to dynamic loads, such as oblique loads, oscillations, vibration or deformation of the ship hull, a container is designed so as to ensure continuous operation without disruptions despite such environmental conditions.

The embodiments described above provide a drive and propulsion system which, by virtue of its redundant design, ensures a comparatively high degree of safety and reliability with regard to maneuverability. The relatively high drive and propulsion system availability is primarily due to the fact that incorrect operating states are detected reliably and quickly, and the necessary measures, such as alarm signaling, power reduction or network disconnection, are initiated without delay. Since ship propulsion systems having a steering propeller arranged outboard, as is envisaged in SSP technology, are subject not only to natural aging and wear by virtue of their operation, but also to external influences such as oblique positions, oscillations, vibration or deformation of the ship hull, which can lead to defects, redundant propulsion systems for ships are essential, for safety-relevant reasons. Not least, however, the present invention also takes account of financial aspects in that the individual assemblies, in particular the control and regulation devices 25*a*, 25*b*, 26*a*, 26*b* are composed of modular standard components, such as those known by the designations SIMADYN D and SIMATIC S7.

Figure 3:
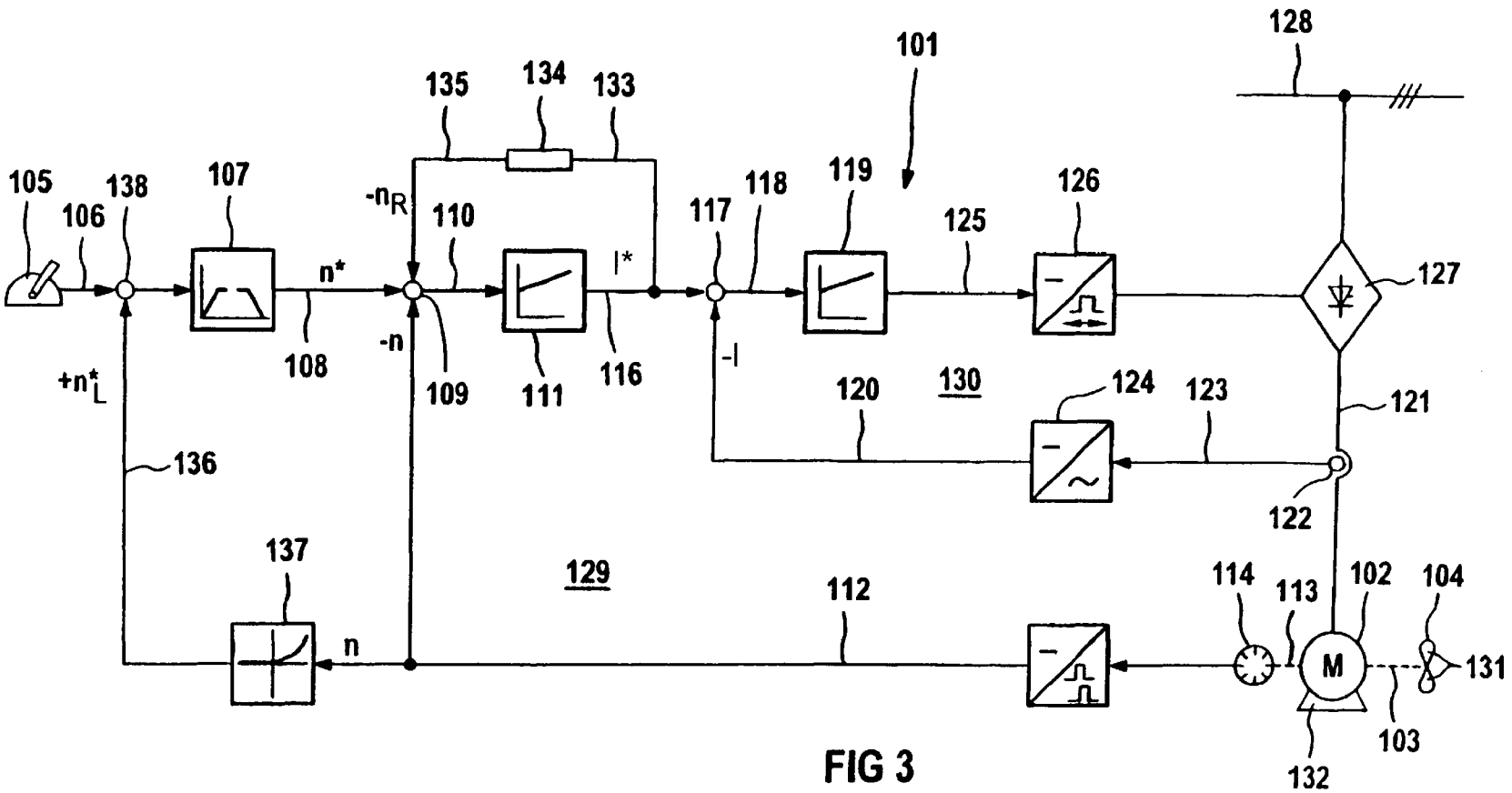
FIG. 3 shows a block diagram of an electric motor drive for the drive and propulsion system according to the invention.

The block circuit 101 in FIG. 3 shows the electric motor drive 102 for the shaft 103 of a ship's propeller 104 on the basis of that part of the regulation device for the drive and propulsion system which is used for the rotation speed nominal value 106 preset by the ship's captain via the machine telegraph 105.

In a conventional propulsion system, abrupt changes in the rotation speed nominal value 106 are converted by a downstream ramp transmitter 107 into ramps with defined rise and fall rates. This modified signal 108 for the rotation speed nominal value n* is passed via a summation point 109 to the input 110 of a rotation speed regulator 111, which preferably has a proportional and an integral element.

Furthermore, inverted measurement signal for the rotation speed n of the electric motor 102, which is determined by means of an incremental transmitter 114 coupled to the shaft 113 of the electric motor 102 in the region of the B-end bearing plate, is passed to the input 110 of the rotation speed regulator 111. This is done by the two phase-shifted square-wave output signals from the incremental transmitter 114 incrementing a count on a pulsed basis, taking account of their phase angles. By forming the difference between the count at the start and the end of each fixed time interval, it is possible to produce a digital signal proportional to the rotation rate, which is then converted to an analog voltage 112 with an amplitude corresponding to the rotation speed nominal value 108. If the regulator 111 can exactly readjust the rotation speed actual value n to the modified rotation speed nominal value 108, then the input signal 110 to the regulator 111 tends to zero due to the subtraction process n*−n at the summation point 109.

If, on the other hand, the input signal 110 is not equal to zero, then the rotation speed regulator 111 changes its finite output signal 116, whose amplitude can be detected as the acceleration torque or braking torque required by the control stage. Since the torque which is produced in the electric motor 102, which is preferably in the form of three-phase asynchronous machine or three-phase synchronous machine, can be made to be approximately proportional to a current flow vector if a suitable control system is used, based on the rotating field but which will not be described in detail here, then the regulator output signal 116 from the rotation speed regulator 111 is at the same time detected, for the purposes of the circuit 101, as a nominal value I* for the corresponding motor current, and is passed as such via a further summation point 117 to the input 118 of a subordinate current regulator 119. This current regulator 119 fundamentally likewise has a PI characteristic, with a proportional and an integral element.

An inverted measurement signal 120 for the motor current I is also passed to the summation point 117, with the signal 120 for the current actual value I being produced from a current actual value 123, which is obtained, for example, by means of one or more shunts 122 connected in the power supply lines 121 for the electric motor 102, by evaluation as an amplitude value in a downstream measurement converter 124. This current amplitude value 120 may, in the case of three-phase asynchronous machines or three-phase synchronous machines 102, correspond to the torque-forming component of the current vector determined from the motor currents 122 while, on the other hand, in a DC motor the measured armature current can be used directly.

The output signal 125 from the current regulator 119 is passed to a controller 126, which acts on a converter 127. The primary of the converter 127 is connected to a three-phase network 128 and is in the form of a converter for a three-phase asynchronous machine or three-phase synchronous machine 102, or in the form of a converter if a DC motor 102 is being used.

The current control loop 130 that is subordinate to the rotation speed control loop 129 ensures optimum controllability of the motor torque 102, which can be used within the higher-level rotation speed control system 129 in order to match the rotation speed actual value 112 exactly to the rotation speed nominal value 108. However, in this case, the motor 102 has to emit a torque that fluctuates with time, since the propeller 104 is subject to an increased braking torque as its blades 131 pass by the skeg or propeller-shaft stay that is fitted to the ship's hull, and the approximately constant means value of the load torque thus has a harmonic superimposed on it whose frequency corresponds approximately to the product of the propeller rotation speed and the number of propeller blades. In order to keep the effect of this fluctuating load torque on the rotation speed actual value n as low as possible, the motor 102 must be continuously changed to a correspondingly changing drive torque whose reaction torque is introduced into the ship's hull via the motor anchorage 132, where it causes oscillations at a corresponding frequency, and these have a damaging effect on the ship's structure; in the opposite direction, the fluctuations of the drive torque via the ship's propeller and its wake field have a disadvantageous effect in that they promote or initiate cavitation on the ship's propeller.

The countermeasure according to the invention is to feed back 133 part of the regulator output signal 116 from the rotation speed regulator 111. In consequence, the modified rotation speed nominal value n* is effectively reduced by a value nR=R*I* if there is any difference between the rotation speed actual value n and the rotation speed nominal value n*, when the rotation speed regulator 111 produces a finite current nominal valued I* in order to produce an opposing torque, by means of the feedback 133, which is supplied to the summation point 109 as an inverted signal 135 that is multiplied by a division factor 134.

In consequence, the regulator 111 attempts to stabilize only at the correspondingly reduced rotation speed nominal value n*−nR, and thus gives the motor 102 the opportunity to release flywheel energy from the drive train 102,103, 104 by reducing the rotation speed n from n* to n*−nR. In the process, the regulator 111 virtually matches the falling motor rotation speed n with a falling rotation speed nominal value n*−nR and scarcely needs to take any control action. The motor 102 thus produces no additional torque, or only a small amount of additional torque, so that no increased torque is introduced into the ship's hull at the motor anchorage 132.

As soon as the propeller blades 131 have assumed another position, the load on the shaft 103 falls and the rotation speed n rises once again without increasing the motor torque. Since the rotation speed actual value n is now greater than the virtual rotation speed nominal value n*−nR the amplitude of the regulator output signal 116 falls, and the system returns to the initial operating point.

Since the rotation speed has been changed only downward during such a cycle, the mean value of the rotation speed n decreases somewhat in comparison to the actual, constant rotation speed nominal value n*, which can be seen in the form a residual control error of approximately 0.2% to 1.5%. In order to counteract this effect, a compensation circuit can be inserted into the nominal value path n*, festively shifting the rotation speed nominal value n* upward by an appropriate count.

In this case, particularly in the case of ship's propeller propulsion systems, se can be made of the fact that the load torque on a propeller 104 rises approximately with the square of its rotation speed n so that, in consequence, the signal 135 which is fed back and is approximately proportional to the drive torque of he motor 102 in the steady state can be detected approximately as a square function of the rotation speed mean value $\tilde{n}$. On the assumption that, on the other hand, the actual rotation speed mean value $\tilde{n}$ is approximately identical to the rotation speed nominal value n*, then, in consequence, the compensator must have a path which rises with the square of the rotation speed nominal value n*. The function according to the invention consists of supplying the rotation speed actual value n, 112 via a function transmitter 137 which maps the compensation described above, as a signal nL*, 136 to the summation point 138, and hence increasing the rotation speed nominal value n*, 106 by a value nL*=(n). Thus, in the steady state, nL*=−nR, and this has the desired effect of the sum of the signal 108 and the signal 135 being equal to the signal 106 at the summation point 109.

Figure 4:
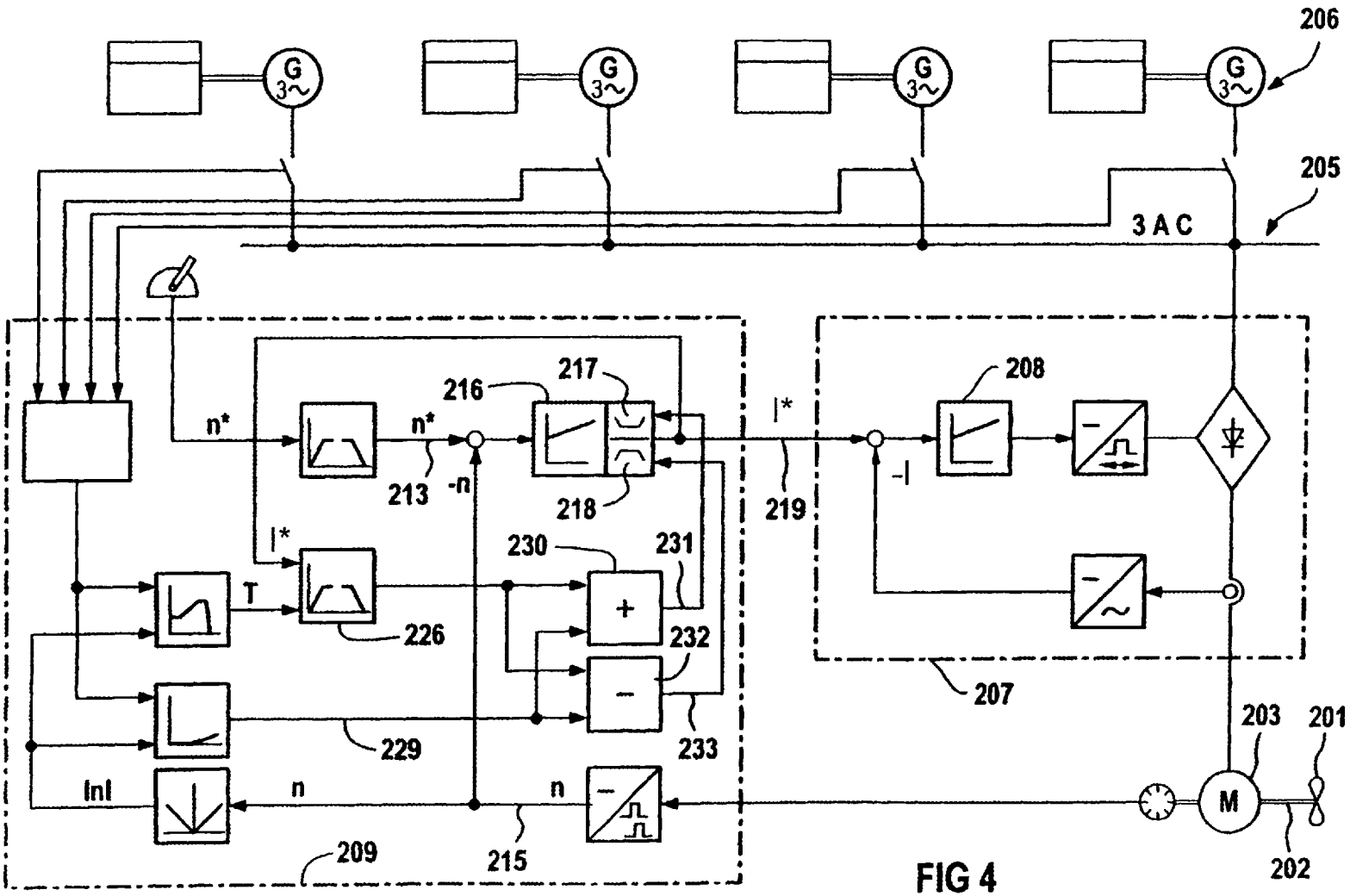
FIG. 4 shows a further block diagram of an electric motor drive for the drive and propulsion system according to the invention.

A drive and propulsion system for a ship's propeller 201 as illustrated in principle in FIG. 4 has an electric propeller motor 203, which is supplied with electrical power from a diesel generator system 206 via an on-board power supply network 205 and a converter 207.

The diesel generator system 206 is shown with four diesel generators but may have a different number of diesel generators. Synchronous generators are normally used in this case.

The ship's propeller 201 is driven by the drive shaft 202 of the electric propeller motor 203.

The electric propeller motor 203 has an associated rotation speed control system 209 and the converter 207 with a current control system, by means of which the rotation speed of the output drive shaft 202 of the electric propeller motor 203, and hence the rotation speed of the ship's propeller 201, can be controlled.

On the input side, a current regulator 208 for the converter 207 receives a current nominal value I* 219 from a rotation speed regulator 216. The current nominal value, I* 219 which corresponds to a predetermined rotation speed n* 213, is applied by the rotation speed regulator 216 not only to the current regulator 208 but also to the input side of an adaptive ramp transmitter 226.

On the output side, the adaptive ramp transmitter 226 has a positive offset step 230 and a negative offset step 232. The two offset steps 230, 232 provide the current nominal value I* 219 with a variation range, with an upper limit 231 and a lower limit 233 of this variation range being passed on from the output side of the adaptive ramp transmitter 226 to the output side of the rotation speed regulator 216, at which an upper current value limiting unit 217 and a lower current value limiting unit 218 are provided.

The upper current value limiting unit 217 and the lower current value limiting unit 218 result in the rotation speed regulator 216 having a variable control range, within which the output-side current nominal value I* 219, which is passed on to the current regulator 208, must remain.

When determining the variation range 226 for the current nominal value based on the provided adaptive ramp transmitter 226, the diesel generator system 206 and the on-board power supply network 205 take account of predetermined limit values. These limit values limit that variation range within which it is possible to vary the current nominal value I* 219 which leaves the rotation speed regulator 216 on its output side. In the process, it must be remembered that it is necessary to ensure that the on-board power supply network 205 can dynamically follow the electric propeller motor 203. The dynamic limits for load changes in the on-board power supply network 205 and on the electric propeller motor 203 are highly dependent on the characteristics of the diesel generator system 206, in which case, in principle, the diesel engines and the generators (which are normally in the form of synchronous generators) in the diesel generator system 206 can be considered separately from one another.

The adaptive ramp transmitter 226 produces a run-up time and a run-down time for the current nominal value I* 219, which is passed on from the rotation speed regulator 216 to the current regulator 208, with the dimensioning of this run-up time and run-down time taking account of the maximum permissible rate at which loads are applied to and removed from the diesel engines in the diesel generator system 206. In order to take account of this, the run-up time and run-up down time defined in the adaptive ramp transmitter 226 are varied in proportion to the magnitude of the rotation speed n 215 of the electric propeller motor 203. This means that the real power consumed by the converter for the drive device has run-up and run-down times which are independent of the rotation speed n 215 of the electric propeller motor 203.

In a lower rotation speed range of the electric propeller motor 203, which corresponds approximately to the maneuvering range, the run-up time and run-down time registered in the adaptive ramp transmitter 226 for the current nominal value I* 219 take account of a minimum run-up time and run-down time which are based on the maximum permissible rate of change of the wattless component output from the synchronous generators in the diesel generator system 206.

Furthermore, the run-up time and run-down time registered in the adaptive ramp transmitter 226 for the current nominal value, I* 219 vary in inverse proportion to the number of diesel generators in the diesel generator system 206. This means that the real power consumed from a diesel generator in the diesel generator system 206 has a run-up time and run-down time which are independent of the operation of the converter 207.

In the steady state, the rotation speed regulator 216 must be able to control the current nominal value I* 219, which is to be passed on to the current regulator 208, without any limitations. Otherwise, considerable beating would occur in the electric propeller motor 203, which would be evident in the ship as mechanical oscillations or structure-borne sound sources, and would promote or else initiate cavitation of the ship's propeller 201. For this reason, the current nominal value I* 219 is passed, as is otherwise normal, from the output side of the rotation speed regulator 216 onward directly to the current regulator 208 for the converter 207 for the electric propeller motor 203. The same current nominal value is, however, also passed in parallel to the adaptive ramp transmitter 226. The output side of this adaptive ramp transmitter 226 thus maps the maximum permissible dynamic range of the diesel generators in the diesel generator system 206, as explained above. In order nevertheless to provide the rotation speed control system for the rotation speed regulator 216 with the required variation width or freedom, the output value of the adaptive ramp transmitter 226 is passed via the positive offset step 230 and the negative offset step 232 to the upper current value limiting unit 217 and, respectively, to the lower current value limiting unit 218 of the rotation speed regulator 216. It is thus possible for the rotation speed regulator 216 to control the current nominal value I* 219 (which is to be passed on to the current regulator 208 for the converter 207 for the electric propeller motor 203) within a variation range whose position and width vary, with this variation range effectively producing a moving window for the current nominal valued I* 219 which is passed on from the rotation speed regulator 216 to the current regulator 208. The rotation speed regulator 216 is free to control the current nominal value, I* 219 within this moving window.

Within this variation range, which is quantitatively variable and whose positioning can be varied, and within the moving window described above, the rotation speed regulator 216 operates with its full dynamic range. This leads to voltage fluctuations in the on-board power supply network 205, since the excitation for the synchronous generators in the diesel generator system 206 can no longer follow the rate of change of the current nominal valued I* 219 there, as it is passed on to the converter 207 for the electric propeller motor 203. The reactive current on the on-board power supply network side from the converter 207 associated with the electric propeller motor 203 produces these voltage fluctuations via the reactance of the synchronous generator which, in the case of ships is generally xd"=14% to 18%. The magnitude of the positive offset 229 and of the negative offset 229, as they are predetermined by the adaptive ramp transmitter 226 for the width of the variation range and of the moving window, are set such that the on-board power supply network side reactive current which results from them or is produced by them produces a voltage drop across the reactance of a generator, and this voltage drop is invariably within the maximum permissible voltage tolerance in the on-board power supply network 205. Rapid voltage fluctuations within the maximum permissible voltage tolerance in the on-board power supply network 205 are not critical for its operation. The positive and the negative offset 229 are a function of the magnitude of the rotation speed n 215 of the electric propeller motor 203, since the power factor on the on-board power supply network side is dependent on the drive level of the converter 207 associated with the electric propeller motor 203.

Furthermore, the positive and the negative offset 229 are proportional to the number of synchronous generators feeding the on-board power supply network 205 in this diesel generator system 206, since the short-circuit rating Sk" in the on-board power supply network 205 is likewise approximately proportional to the number of synchronous generators feeding the on-board power supply network 205 in the diesel generator system 206.

Figure 5:
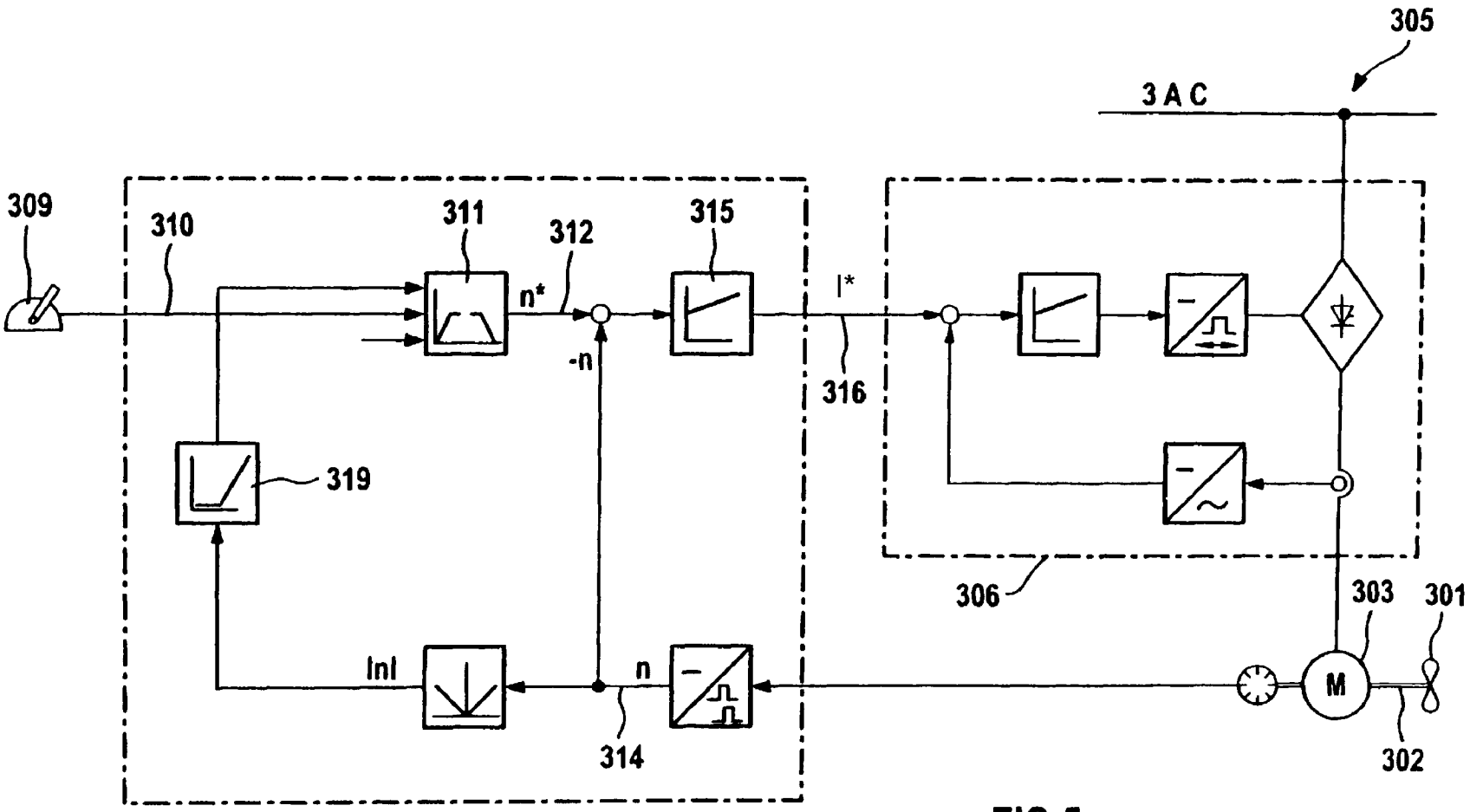
FIG. 5 shows a further block diagram of an electric motor drive for the rive and propulsion system according to the invention.

A drive and propulsion system (which is illustrated in principle in FIG. 5) for a ship's propeller 301 has an electric propeller motor 303 whose output drive shaft 302 drives the ship's propeller 301.

The electric propeller motor 303 is normally supplied with electrical power from the on-board power supply network 305 via a converter 306.

A rotation speed regulator 315 controls the operation of the electric propeller motor 303. The rotation speed of the output drive shaft 302 of the electric propeller motor 303 is set via the converter 306 by means of the output signal from the rotation speed regulator 315, the torque nominal value or the current nominal value I* 316.

In order to keep the operating state of the electric propeller motor 303 within a permissible range, the rotation speed regulator 315 has an associated ramp transmitter 311. A rotation speed nominal value for the electric propeller motor 303 or for the ship propeller 301 can be entered in the adaptive ramp transmit 311 by means of an input unit 309.

The adaptive ramp transmitter 311 contains a characteristic transmitter 319, which modifies the signal n* 312, which is passed on to the rotation speed regulator 315 from the output side of the adaptive ramp transmitter 311, as a function of the magnitude of an actual rotation speed n 314 of the output drive shaft 302 of the electric propeller motor 303, in order to match the actual rotation speed n 314 of the output drive shaft 302 to the nominal rotation speed 310 preset on the input unit 309 appropriately in characteristics stored in it. In this case, the magnitude of the actual rotation speed n 314 of the output drive shaft 302 of the electric propeller motor 303 is used as a reference variable for the signal n* 312 which is passed on from the adaptive ramp transmitter 311 to the rotation speed regulator 315.

In this case, different characteristics for the run-up time are stored in the characteristic transmitter 319 in the adaptive ramp transmitter 311.

The response of the adaptive ramp transmitter 311 in the drive and propulsion system can be used to add a definable acceleration torque to a steady-state load torque. This definable acceleration torque remains constant, to a certain extent, in the region of the propulsion mode, that is to say in the region of the higher actual rotation speed range of the electric propeller motor 303, and thus has no unnecessary high values at times.

Figure 6:
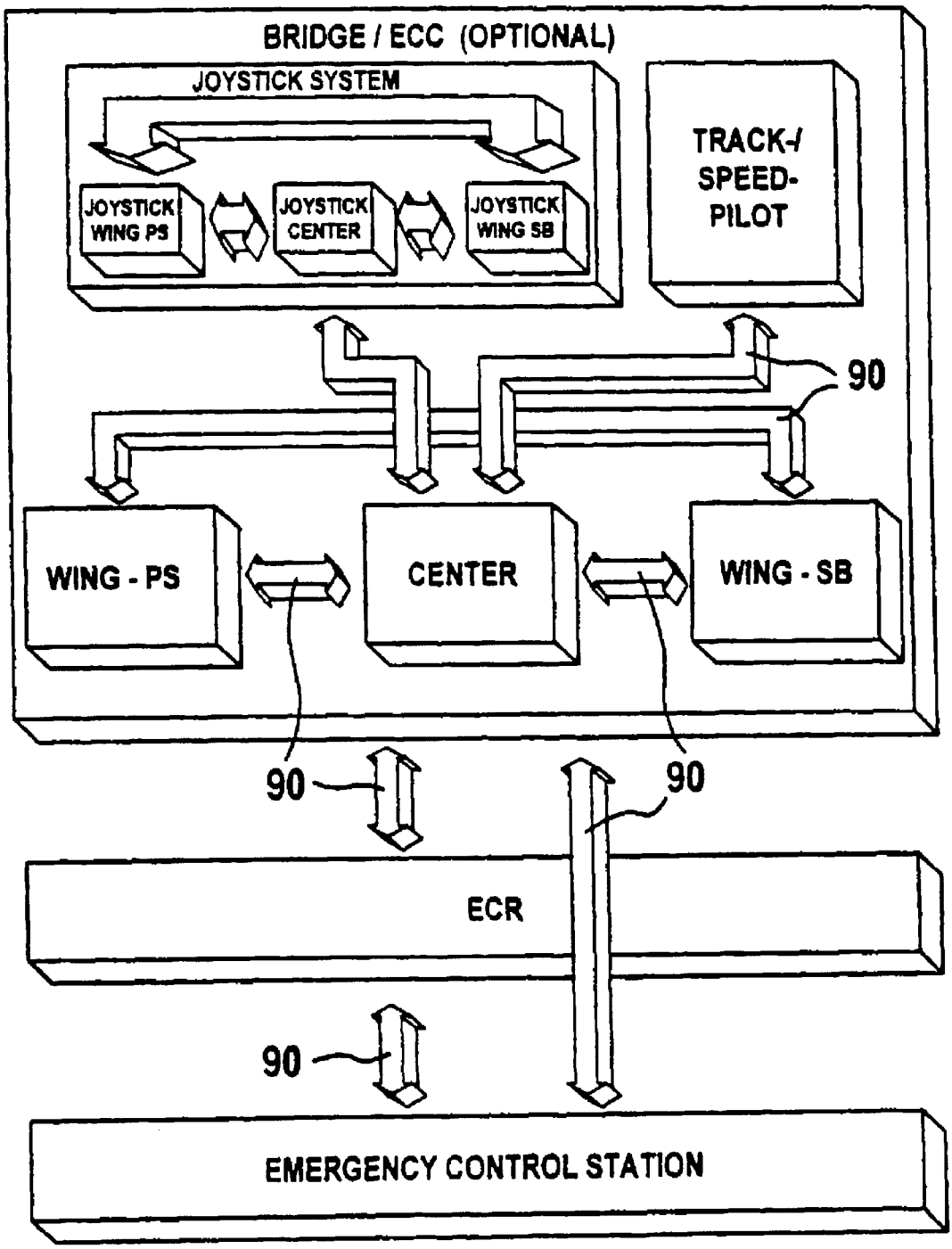
FIG. 6 shows an outline illustration of a drive and propulsion system according to the invention, showing the connection via a bus system from control stations for the control device.

FIG. 6 uses a block diagram to show the various control options for the control device. All control station changes that are preset via input and output elements on the control station and on the emergency control station are carried out without any sudden changes in the nominal value. Readjustment of the control lever on the control station (bridge) and by appropriate key control on the other control stations means that there is no need for manual readjustment of the control levers. When the control station is active (main control station: bridge), the nominal values for the rotation speed and thrust direction of the propeller drives are preset from this control station, as is shown in the upper box in FIG. 6. When the control station in the Engine Control Room (ECR) is active, this is used to preset only the rotation speed, as is shown in the second box from the top in FIG. 6. The thrust direction is preset from the control station on the bridge. In this case, there is no capability for any control station changes, in particular joystick, track/speed pilot and tandem operation. When the emergency control station is active as the control station (Emergency Control Station ECS), the nominal value for the thrust and thrust direction are preset jointly by push buttons on the emergency control station. There is no capability for joystick, track/speed, pilot or tandem operation. The commands are preset by the bridge using the telephone, for example the thrust direction and thrust, or by means of an emergency telegraph that is installed, for example the thrust. The individual control stations and their modules are in this case connected to one another for communication purposes by means of a ring bus system 90, as is shown in FIG. 6.

Figure 7:
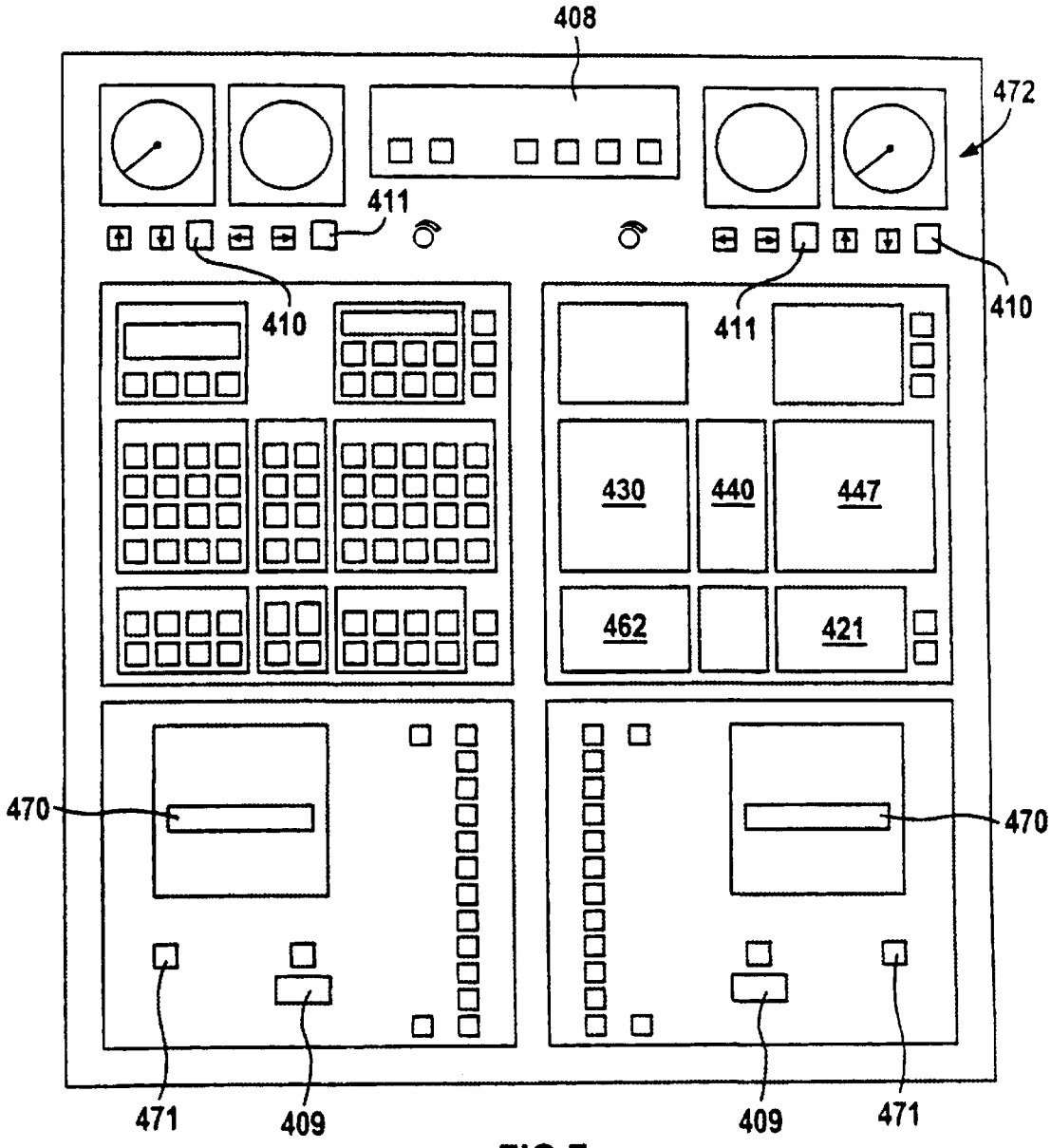
FIG. 7 shows an exemplary embodiment of an input and output elements for a control station for the drive and propulsion system according to the invention.
Figure 10A:
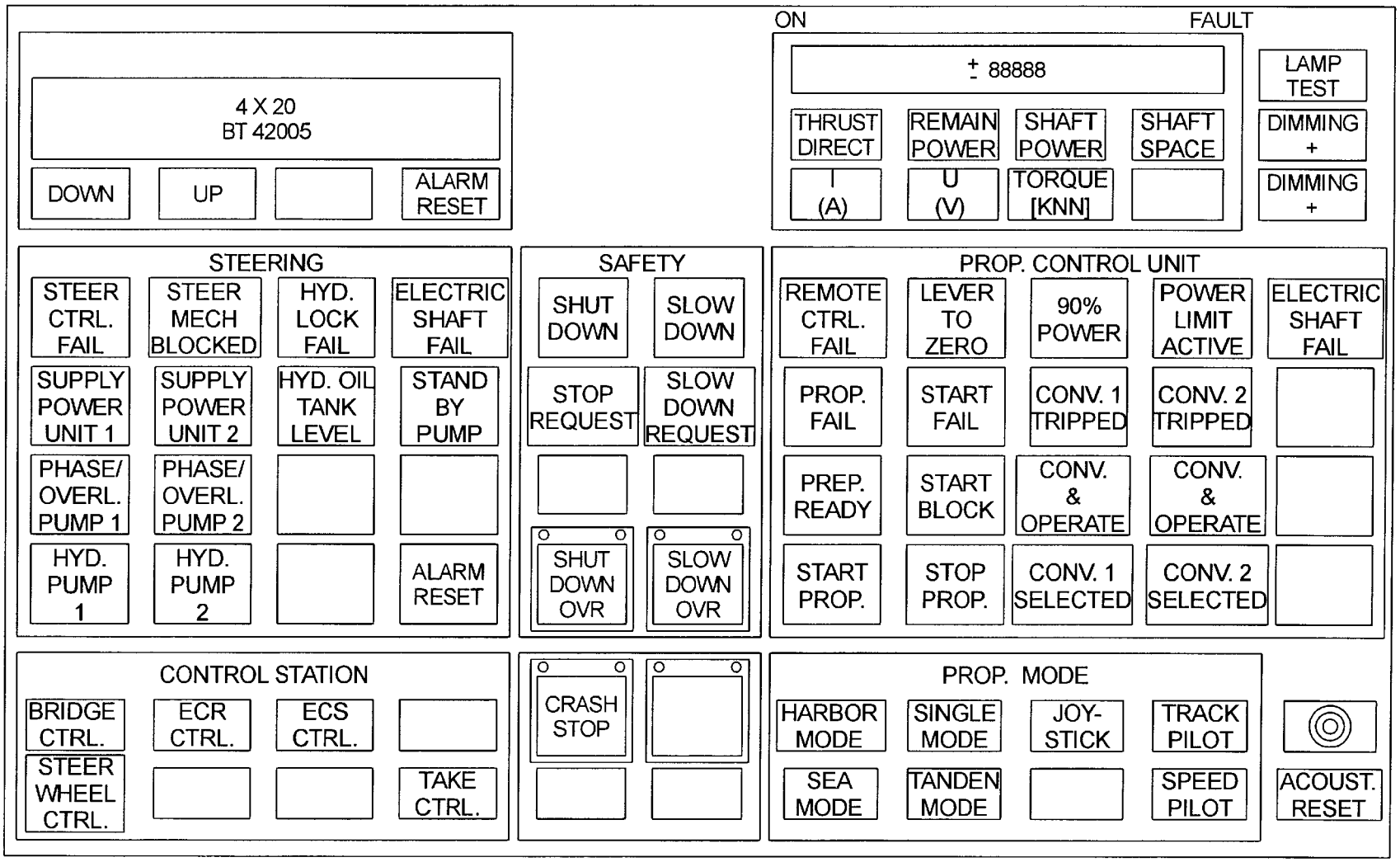
FIG. 10*a* is an enlarged portion of the subregion of the input and output module of FIG. 7 with the labels on the push buttons.
Figure 10B:
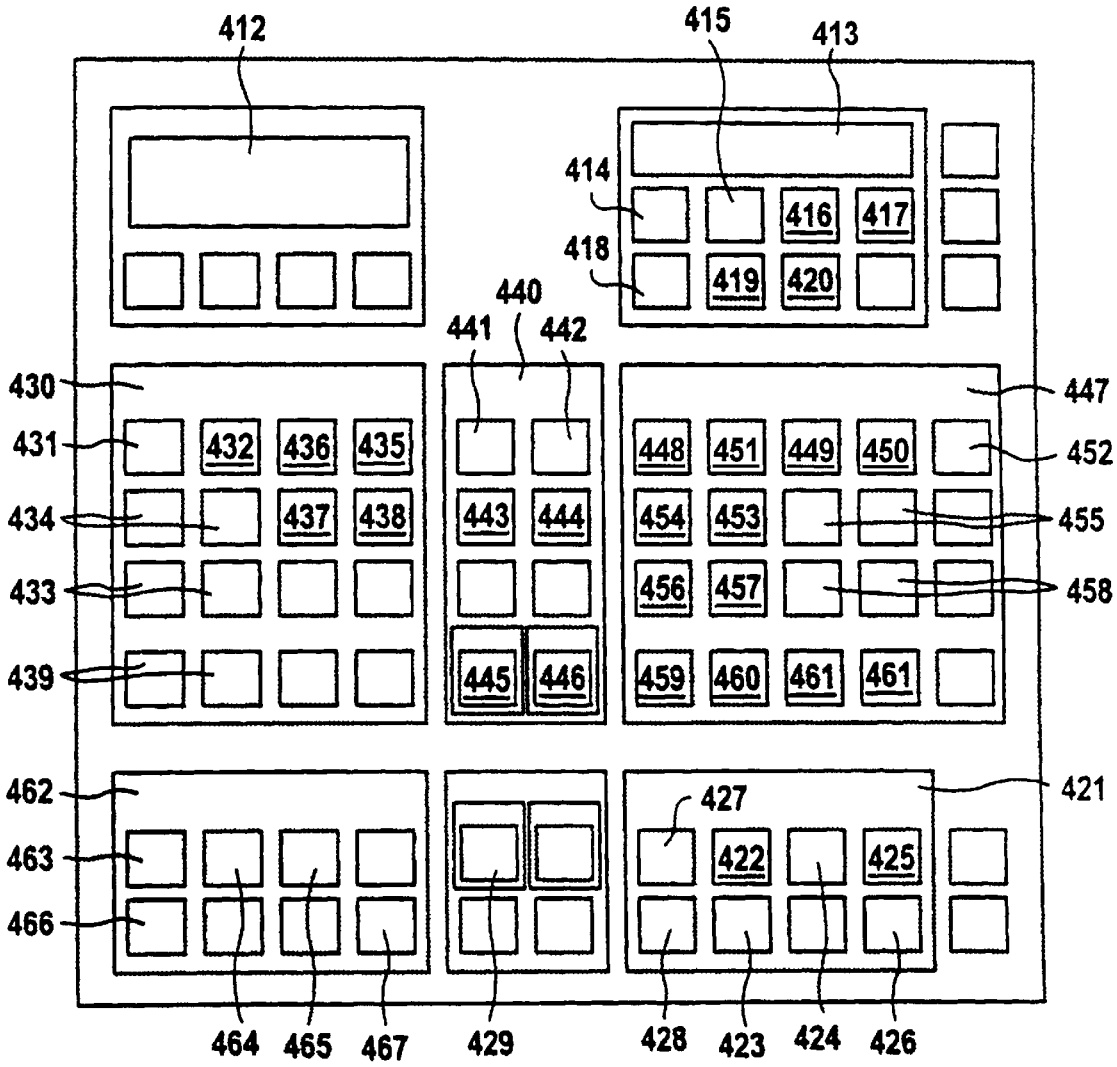
FIG. 10*b* is an enlarged portion of the subregion of FIG. 10*a* without the labels.

FIG. 7 shows the layout of an input and output elements in the control device for a drive and propulsion system according to the invention, as is used as the main control station on the bridge of a ship. The input and output elements in this case comprises a number of text displays with a resolution of four lines, each with 20 characters. Furthermore, the input and output elements has a number of push buttons, which will be explained in more detail in the following text. FIGS. 10*a*, 10*b* in this case show a detail of a subregion of the input and output module, in the form of a module.

The active diesel generators are selected and displayed on the input and output elements panel inscribed "DIESEL GENERATOR". A 100% push button allows all the generators that are at readiness to be connected to the on-board power supply network.

The "OPERATION BLOCK" push button is used to prevent operation of the propulsion system and to set the converters for the electrical on-board power supply network to regulator block. In this case, all function push buttons which switch the respective drive are blocked. Furthermore, nominal value presetting by means of the control lever is blocked, as is selection of the emergency operation push buttons for presetting nominal values for the rotation speed and thrust direction. The "OPERATION BLOCK" push buttons have flaps to protect them against inadvertent operation. The activated function is signaled by means of a continuous light. The blocking can be canceled only with the control lever in the Stop position and with at least two generators connected to the network.

The actual values of the shaft rotation speed and SPP position for both drives are shown on the input and output elements on the control station on the bridge. The indications are in this case in a 96×96 mm format.

All the indications on the input and output elements on the control station on the bridge can be dimmed using dimming potentiometers. The indications on the membrane keyboard of the input and output elements are in this case implemented via the integrated dimming function.

The "Emergency Speed Control" illuminated push button 410 is used to change the presetting of the respective drive rotation speed to the emergency control push buttons. When emergency control is active, the lamp is illuminated continuously. When the push buttons to increase or reduce the rotation speed are operated, the corresponding push buttons illuminate. The lamps illuminate when the push button is pressed and emergency control is selected. The push buttons are connected (wired) directly to the rotation speed regulator by means of appropriate cables.

The "Emergency Steering Control" illuminated push button 411 is used to change the presetting of the thrust direction of the respective drive to the Emergency control push buttons. When emergency control is active, the lamp is illuminated continuously. When the push buttons for a turn to port or starboard are operated, only the appropriate push buttons are illuminated. The lamps are illuminated only when emergency control is active. The push buttons act directly on the control hydraulic valves.

The most important defect messages are displayed in plain text on the alarm text display 412. Four push buttons are provided for operation of the alarm system and in this case are arranged underneath the alarm text display 412.

The analog value display 413 can display eight analog values from the drive system. The analog values are in this case selected via the push buttons described in the following text. The selected function is indicated by means of an LED. Each selected indication is in this case automatically deselected once again after about seconds. The available power (remaining power (kW)) is displayed after deselection.

The "thrust direction" push button 414 is used to select the thrust direction indication. The "Remaining Power" push button 415 is used to display the available power. The "Shaft Power" push button 416, is used to select the shaft power display. The "Shaft Speed" push button 417 is used to select the shaft rotation speed display. The "Stator Current" push button 418 is used to select the stator current display. The "Stator Voltage" push button 419 is used to select the stator voltage display. The "Torque" push button 420 is used to select the torque value display.

The module annotated "Propulsion Mode" on the input and output elements on the control station on the bridge has push buttons and indications/displays in this area 421 which are to used to select the operating modes. In detail, these push buttons have the following functions:

In "Single Mode"(push button 422), both SPP propulsion systems are operated separately. The propulsion commands for the thrust direction and rotation speed are preset for the respective drive by the control lever on the active control station. The port control lever operates the SSP propulsion system on the port side, and the starboard control lever operates the SPP propulsion system on the starboard side. This push button 422 is enabled only when the control station is selected on the bridge.

In "Tandem Mode"(push button 423), the commands for both drives are preset via one control lever. The tandem operation master is the command station on which the "Tandem Mode" push button 423 was most recently activated. This push button is enabled only when the control station that is selected is on the bridge.

The "Joystick" push button 424 is used to select the joystick mode. In the joystick mode, the nominal values for the control angles and rotation speed are preset using the joystick system. Those control levers which have an electric shaft are readjusted via this shaft. The "Joystick" push button 424 is enabled only when the control station that is selected is on the bridge.

The "Track Pilot" push button 425 is used to transfer the propulsion command for the azimuth preset to the track pilot. When the track pilot is activated, the azimuth is preset via this system. The control levers on the control stations on the bridge are readjusted via the electric shaft. The push button is enabled only when the control station that is selected is on the bridge. During selection, the push button 425 blinks. When track pilot is activated, the lamp in the push button 425 is illuminated continuously.

The "Speed Pilot" push button 426 is used to transfer the propulsion command for presetting rotation speed nominal values to the speed pilot. When the speed pilot is activated, the rotation speed nominal values are preset via this system. The control levers on the control stations on the bridge are in this case readjusted in the same way via the electric shaft. The "Speed Pilot" push button 426 is enabled only when the control station that is selected is on the bridge. The push button 426 blinks during selection. When the speed pilot is activated, the lamp is illuminated continuously.

The "Harbor Mode" push button 427 is used to select what is referred to as the harbor mode. In the harbor mode, there is no restriction on the SSP rotation angle. The thrust direction rate of change is set to the maximum. This is done by starting a second hydraulic pump in the SSP. In the harbor mode, automatic shutdown of the generators is blocked. The push button 427 is enabled only when the control station that is selected is on the bridge of the ship.

The "Sea Mode" push button 428 is used to select the sea mode. In the sea mode, the control angle of the SSP is limited to about ×/−35%. The thrust direction is changed using one hydraulic pump. The push button 428 is enabled only when the control station that is selected is on the bridge of the ship.

The "Crash Stop" push button 429 starts or stops the crash stop sequence. When the crash stop function is activated, this push button is illuminated continuously. The crash stop function is started and stopped jointly for all the active drives (SSP). This push button has a protective cover to protect it against inadvertent operation, and is enabled only on the active control station on the bridge.

Those push buttons and indications/displays which are intended for operation and alarm functions relating to changes in azimuth are arranged in the area annotated "steering" 430 on the input and output element of the control device for the drive and propulsion system.

The "Steering Control Failure" indication 431 indicates a failure of the control system for SSP movement. No rudder movement is available.

The "Steering Mechanic Blocked" indication 432 has a red continuous light to indicate that azimuth movement of the SSP is mechanically blocked. In this condition, this system cannot be used for control purposes. This system can be used for forward propulsion, with a restricted torque. The "Phase/Overload Pump" indications 433 indicate phase faults or overloads on hydraulic pumps 1 and/or 2.

The "Supply Power Unit ½" indications 434 indicates faults or loss of the electrical power supply for the hydraulic pump 1 and/or 2 for azimuth movement.

The "Electric Shaft Failure" indication 435 appears with a red continuous light when the electric shaft for control levers for presetting the thrust direction has failed or is signaling a fault.

The "Hydraulic Locking Failure" indication 436 indicates that the hydraulics for azimuth movement are not operating. In this case, the SSP will not follow the preset rotation angle nominal value.

The "Hydraulic Oil Tank Level" indication 437 has a red continuous light to indicate loss of hydraulic oil in the SSP azimuth movement hydraulic system. This occurs when the hydraulic oil level reaches the minimum level.

The "Emergency Pump" indication 438 indicates a fault in the hydraulic system which has led to a loss of pressure. In this case, that hydraulic pump which is not active is started automatically. The faulty pump is switched off. This function is indicated by a red continuous light. The automatic changeover is active only in the "Sea Mode", which can be activated by means of the push button 428.

The "Hydraulic Pump ½" push button 439 is used for selecting and indicating operation of the respective pump 1 or 2 in the hydraulic system for SSP azimuth control. The push button 439 is enabled only on the selected control station on the bridge of the ship.

Those push buttons and displays/indications which are intended for operation and alarming of a safety system are arranged in the "Safety System" area annotated 440.

The "Shut Down" indication 441 appears when an automatic shutdown occurs following complete failure of the drive.

The "Slow Down" indication 442 has a red continuous light to provide an alarm for an automatic reduction in the drive. An automatic reduction can be ended by means of the "Slow Down Override" push button 446. The "Stop Request" indication 443 uses a red blinking light to signal a request for that drive to be stopped, in order to protect the mechanism.

The "Slow Down Request" indication 444 uses a red blinking light to produce an alarm for a request to reduce the drive, in order to protect the mechanism.

The "Shut Down Override" push button 445 is used to override an automatic shutdown. An automatic shutdown, which can be overriden by an operator, is indicated in advance by a blinking red "Shut Down" indication. In this case, there is a time delay involved in overriding the shutdown. The push button 445 has a protective cover to protect it against inadvertent operation, and is enabled only on the selected control station on the bridge of the ship.

The "Slow Down Override" push button 446 is used to override an automatic reduction. An automatic reduction, which can be overriden by an operator, is indicated by a blinking red indication on the "Slow Down Override" lamp. The push button 446 is enabled only on the selected control station on the bridge of the ship. The push button has a protective cover to protect it against inadvertent operation.

Those push buttons and displays/indications which are intended for operation and producing alarms relating to the electrical drive system are arranged in the area annotated "Propulsion Control PCS" 447.

The indication "Remote Control Failure" 448 appears when the control lever cannot be used to control that system. The emergency control push buttons must be selected, as already explained above.

The "90% Power" indication 449 appears when a red continuous light when the power generation protection system identifies that 90% of the available power has been reached.

The "Power Limit Active" indication 450 appears with a red continuous light when drive limiting is active.

The "Lever to 0" indication 451 appears with a red continuous light when the system state means that the control lever must be moved to the zero position.

The "Electric Shaft Failure" indication 452 appears with a red continuous light when the electric shaft for presetting the rotation speed has failed, or is signaling a fault.

The "Start Fail" indication 453 appears with a red continuous light when the start sequence is interrupted by a fault. This indication is canceled again after activation of the stop or start sequence.

The "Propulsion Failure" indication 454 appears with a red continuous light when the drive control system identifies a failure within the propulsion system.

The "Converter Tripped" indication 455 illuminates with a red continuous light when the converter 1 or 2 for the SSP has failed.

The "Propulsion Ready" indication 456 appears with a green continuous light when the drive and control system are ready to operate. If the start sequence has been completed and the propulsion system is not ready to operate, this indication blinks. The lamp is extinguished once the stop sequence has been completed.

The "Start Blocked" indication 457 appears with a red continuous light when the system is not ready to be started. This indicates that it is not possible to start at the start sequence.

The "Converter in Operation" indication 458 appears with a green continuous light when the converter unit 1 or 2 is connected to the network, and is ready to operate.

The "Start Propulsion" push button 459 is used to start the drive system automatically. This includes switching the cooling system to the propulsion mode, switching on the converter, demanding azimuth movement from the hydraulic pumps, and releasing the shaft brake. During the start sequence, this indication blinks with a green light. During the sequence quiescent state, the lamp is off. The push button 459 is enabled only on the selected control station on the bridge of the ship.

The "Stop Propulsion" push button 460 is used to shutdown the propulsion system automatically. This includes switching the cooling system to standby, switching off the converters, stopping the hydraulic pumps for azimuth movement and, finally, inserting the shaft brake. During the stop sequence, this indication blinks with a red light. During the sequence quiescent state, the lamp is illuminated with a red continuous light. The push button is enabled only on the selected control station on the bridge.

The "Converter Selected" push button 461 is used for selecting converter 1 or 2. Pressing the push button selects or deselects the converter 1 or 2. At least one converter 1 or 2 must be selected. For selection, the system must be in the off state. The push button is enabled only on the selected control station on the bridge of the ship.

Those keys and displays/indications which are used for selecting and indicating or displaying the active control station are arranged in the area 462 annotated "Control Station".

The "Bridge Control" push button 463 is used to select the control station on the bridge. The lamp in the push button 463 indicates that the process of changing the control station to the bridge has been initiated, and indicates that the active control station is that on the bridge.

The "ECR Control" push button 464 is used for selecting the ECR (Engine Control Room) control station. The lamp in the push button 464 indicates that the process of changing the control station to the ECR has been initiated, and that the active control station ECR is active.

When the "ECS Control" indication 465 is illuminated, the emergency control station is activated. It is not possible to control the propulsion system from the bridge.

The "Steering Wheel Control" push button 466 is used to select the steering wheel (helm) control station. The push button 466 blinks when this transfer is initiated. The transfer is carried out by means of the "Take Control" push button 467 on the steering wheel control station. This is signaled by means of a continuous light. The push button is enabled only on the selected control station on the bridge of the ship.

The "Take Control" push button 467 is intended for confirmation and for transferring the control station, and is used when changing the control station. When requested, the "Take Control" lamp blinks in the push button 467. When the indication is illuminated with a continuous light, only this control station is activated. This indication is used to distinguish between the active auxiliary control stations on the bridge.

The control levers 470 for SSP port and starboard are used for presetting the rotation speed and the thrust direction of the drive. The control levers on the individual control stations, that is to say the emergency control stations, bridge and the like, are connected to one another via an electric shaft. Those control stations which have not been selected are thus readjusted for the thrust and thrust direction. In the tandem mode, the electric shafts of both drives are connected to one another. The nominal values for the thrust and direction are preset for both drives via one control lever. When a higher-level control system is selected for the control device for the drive and propulsion system, such as the track/speed pilot or the joystick, the control levers are readjusted on the basis of the reference for the rotation speed and thrust direction. The propulsion levers on the input and output element of the control station on the bridge have an override function during joystick or track/speed pilot operation. The operator has the capability to use the control levers 470 to intervene in the propulsion operation during joystick or track/speed pilot operation.

The "Emergency Telegraph" push button allows the propulsion commands to be transmitted from the control station on the bridge of the ship to the ECR and emergency control stations, as is illustrated in FIG. 6. The commands from the push-button telegraph are to be carried out in sequence in the ECR and emergency control stations. An audible signal is produced in the ECR and emergency control stations until the command from the bridge has been confirmed. As illustrated in FIG. 6 and as already explained, the control stations are in this case connected to one another via a ring bus connection 90 for communication.

An emergency stop push button 471 is provided for each drive, and has a protective cover to protect it against inadvertent operation. The emergency stop is independent of the respectively active control station. The push button 471 that has been pressed is indicated by blinking.

Indications/displays for the shaft rotation speed, shaft power and rudder position of an SSP for port and starboard are provided in the upper area of the input and output element of a bridge control station for the control device shown in FIG. 7. The indications/displays have a size of approximately 144×144 mm, and can be dimmed via a common dimming apparatus. The dimming apparatus is in this case integrated in the input and output element of the control device and, in the present example, is annotated by the reference symbol 472.

Steering commands are passed to both SSPs using the steering wheel (helm) arranged in the center of the control station on the bridge. When the steering wheel is in the active control state, the maximum rotation angle of the SSP is restricted to about ±35%. When the control station is active, the "Take Control" lamp 467 is illuminated with a continuous light. The change from the main control station on the bridge to a steering wheel control station is carried out via the main control station. The lamp in the "Take Control" push button 467 blinks when it is selected. The lamp changes to a continuous light when the control station is transferred by operating the "Take Control" push button 467.

Figure 8:
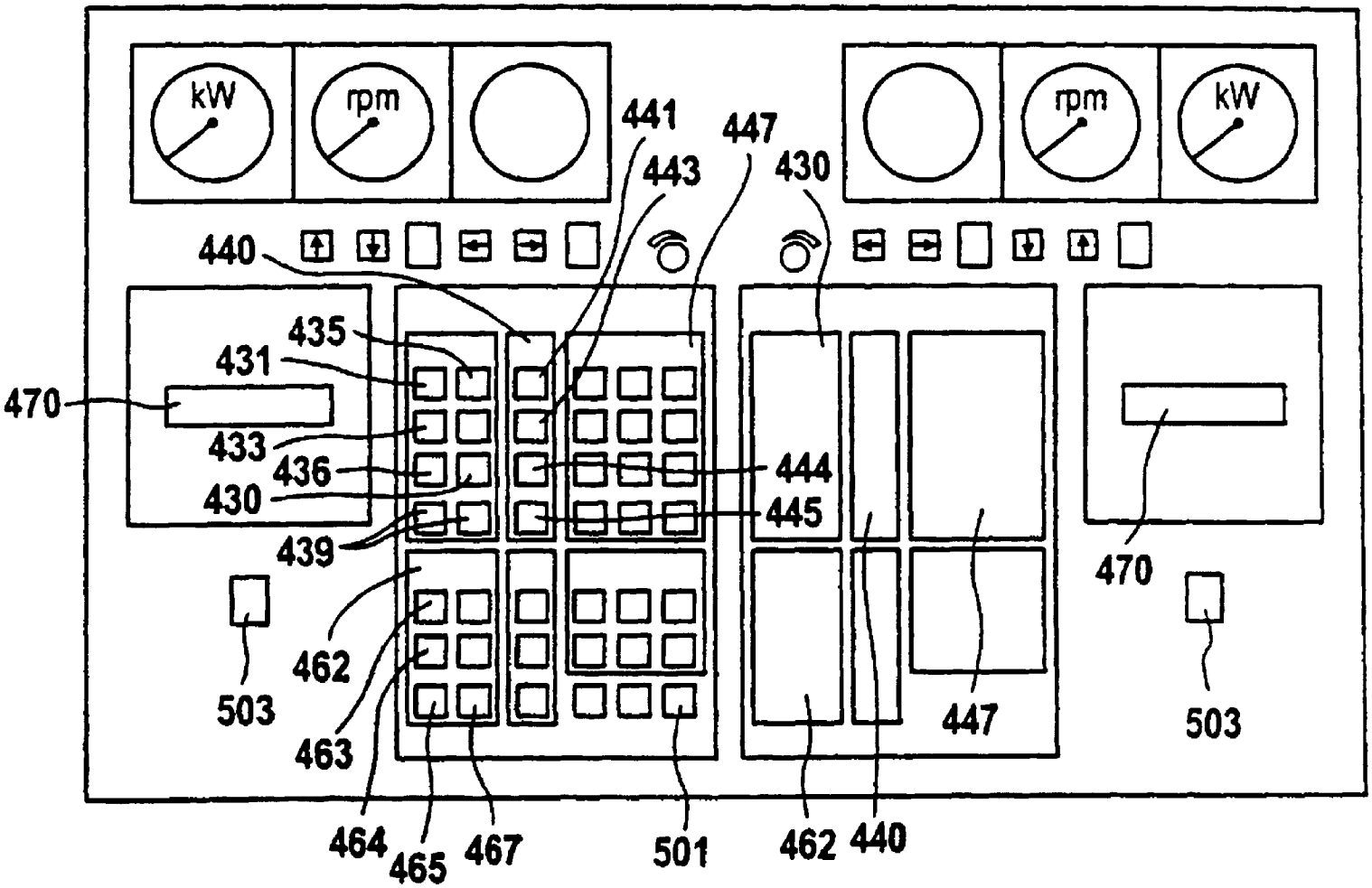
FIG. 8 shows a further exemplary embodiment of an input and output elements for a control station for the drive and propulsion system according to the invention.

FIG. 8 shows an exemplary embodiment of an input and output element on an emergency control station. As can be seen from FIG. 8, the input and output element on the emergency control station has fewer input and output elements than the input and output element for the control station on the bridge of a ship, as illustrated in FIG. 7, but the functions required for emergency control are also implemented in the input and output element of an emergency control station as shown in FIG. 8.

Instead of the analog value display 413 provided in FIG. 7, the input and output element of an emergency control station as shown in FIG. 8 has instruments with pointers to indicate the actual values of the shaft power for both drives and, in a corresponding way to the indications for the actual values of the shaft rotation speed from the SSP position, have an approximately 96×96 mm format.

As already explained, the modules of the input and output elements in the various control stations are connected to the control device, the regulation device, the azimuth modules, the propulsion modules, the various modules of the regulation device and the motors of the drive and the like, and to one another, by means of a ring bus system. This allows extremely simple communication between the various modules and, furthermore, simultaneous value checking using a dialog process, with simultaneous display on the input and output element.

Figure 9:
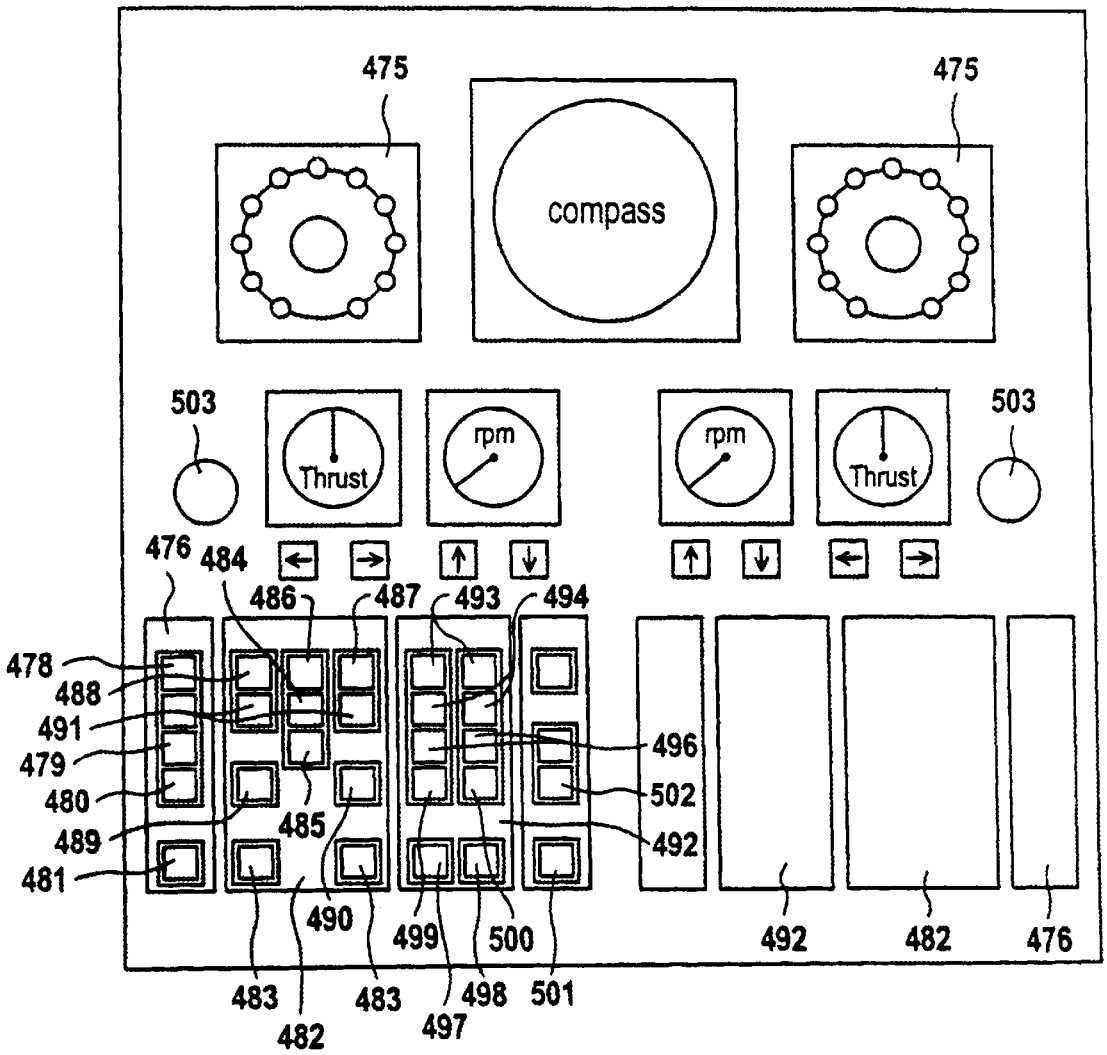
FIG. 9 shows an exemplary embodiment of an input and output elements for an emergency control station for the drive and propulsion system according to the invention.

FIG. 9 shows a further embodiment of an input and output element of an emergency control station for the control device. This is what is referred to as an "Emergency Control Station" and is arranged, for example, in the aft end of the ship. The input and output element of the control device shown in FIG. 9 is in this case likewise connected via a ring bus system to the various modules of the drive and propulsion system for ships. Furthermore, the input and output element is directly connected to the drive motors, to the azimuth modules, to the propulsion modules and the like, in order to control them, so that, for example, a failure in the ring bus system does not result in it being impossible to control the drive and propulsion system from the emergency control station shown in FIG. 9. Furthermore, the direct wiring of the input and output element of the emergency control station allows the provision of a redundant communication link to the various modules in the drive and propulsion system.

The emergency control station shown in FIG. 9 contains the control elements for local control of the SSP for port and starboard. In detail, the indications/displays and push buttons have the following functions:

The "Emergency Telegraph", which has already been explained above, allows the propulsion commands to be transmitted from the control station on the bridge of the ship to the emergency control station shown in FIG. 9. The commands from the push button telegraph 475 must be carried out in sequence on the emergency control station. The actual values of the shaft rotation speed and thrust direction for both drives are displayed on the input and output element on the emergency control station. The indications/displays are in this case in the same format of about 96×96 mm as that shown in FIG. 9, and which has already been described in more detail in conjunction with FIGS. 7 and 8.

When the emergency control station is active, the push buttons underneath the indication/display, for the shaft rotation speed are enabled for rotation speed control. When the push buttons to increase or reduce the rotation speed are operated, the corresponding push button illuminates. The lamps illuminate only when the commands on the emergency control station (ECS) are enabled. The control levers on the bridge are readjusted as appropriate.

The appropriate push buttons illuminate when the push buttons for port and starboard rotation, underneath the display of the actual values for the thrust direction, are operated. The lamps illuminate only when the commands on the emergency control station (ECS) are enabled. The push buttons are active as the control state only when the emergency control station is selected. The control levers on the control station on the bridge are readjusted as appropriate.

Those push buttons and indications/displays which are used for selecting and indicating the active control station as the control station are arranged in the area 476 annotated "Control Station" on the input and output elements of the emergency control station shown in FIG. 9.

The "Bridge Control" indication 477 indicates that the active control station is that on the bridge of the ship. The "ECR Control" indication 478 indicates that the active control station is that in the engine room (ECR Engine Control Room). The indication 479 indicates that the active control station is the emergency control station (ECS). When this indication 479 illuminates with a continuous light, the emergency control station is the active control station. The control station 1 on the bridge of the ship cannot be operated.

The "POD Control" indication 480 indicates that the control station POD in the POD has been selected and is active. Remote control is not possible.

The "Selector REM/ECS" selection switch 481 is used to select and deselect the emergency control station "ECS" as the control station.

Those push buttons and indications/displays which are intended for operation and producing alarms relating to azimuth control are arranged in the area 482 annotated "Azimuth Control".

The "Hydraulic Pump" push button 483 is used for selecting and indicating operation of the pump in the hydraulic system for SSP azimuth control. This push button is enabled only when the emergency control station is selected.

The "Hydraulic Failure" indication 484 indicates that there is a fault in the hydraulic system for SSP azimuth control. In this case, an indication can indicate loss of rudder control.

The "Collective Failure" indication 485 is a collective alarm signal and illuminates when at least one fault has occurred in the control device for the drive and propulsion system for ships, or a fault has occurred in the auxiliary equipment within the SSP housing.

The "Break Active" push button 486 is used to insert the shaft brake of the drive, and to remove it. The shaft brake can be inserted only when neither of the converters for the drives is in operation. The lamp in the push button 486 in this case provides feedback as to whether the shaft brake is inserted.

The "POD cover" push button 487 is used to reactivate the locking bolt for the "POD access door". The push button can be operated only when the emergency control station (ECS) is selected and the brake is applied. The lamp in the push button 487 in this case indicates unlocking.

The "POD Pos." push button 488 is used to place the PUD in the basic position. The basic position is equivalent to 0°. When the POD reaches the basic position, the lamp in the push button 488 illuminates.

The "Fan On" push button 489 switches on the fan for the POD. In this case, the lamp in the push button 489 indicates the status of the fan.

The "Heater On" push button switches on the heating for the PUD capital letters. The lamp in the push button 490 in this case indicates the status.

The "Disconnecting Valve" indication 491 indicates that the shut-off valve between the first hydraulic pump or the second hydraulic pump and the hydraulic tank is closed.

Those push buttons and indications/displays which are intended for operation and producing alarms in the electrical drive system are arranged in the area annotated "Propulsion Unit" 492.

The "Converter Selected" push button 493 is used for selecting the converter 1 or 2. Pushing the button selects or deselects the converter 1 or 2. In this case, at least one converter 1 or 2 must be selected. The system must be in the off state for selection.

The "Converter Run" indication 494 appears with a green continuous light when the converter unit 1 or 2 is connected to the network and is ready to operate.

Each SSP has two systems for power and speed control (PSU). These systems have the task of protecting the generating system and controlling the rotation speed of the drive. One system is always active in this case. In the event of a fault, the operator can switch to the other system. The "PSU 1/2 SEL" push button 496 is used to select the active power and speed control system 1/2. When one system is selected, the other system is automatically deselected. The push button 496 is enabled on both the control station and the emergency control station (ECS). The drive must be switched off before a new system can be selected.

The "Start Propulsion" push button 497 is used for starting the drive system automatically. This includes switching-the cooling system to the propulsion mode and switching on the converters. During the start sequence, the indication in the push button 497 blinks with a green light. In the quiescent state during the start sequence, the lamp is off. The push button 497 is enabled only when the emergency control station is selected. From the emergency control station, the "Start Propulsion" push button 497 just makes the converters ready to operate. The systems for azimuth control and the shaft brake must be operated using the push button in the "azimuth control" area 482. The "Start Propulsion" push button 497 can be operated only when the shaft brake is not activated.

The "Stop Propulsion" push button 498 is used to stop the drive system automatically. This includes switching the cooling system to emergency and switching off the converters. During the stop sequence, the indication in the push button 498 blinks with a red light. During the quiescent state in the sequence, the lamp illuminates with a red continuous light. The push button 498 is enabled only when the emergency control station is selected. The hydraulic pumps for azimuth control are stopped, and the shaft brake is applied, by an additional control action in the "Azimuth Control" area 482.

The "Propulsion Ready" indication 499 appears with a green continuous light when the drive and the control system are ready to operate. If the start sequence has been completed and the propulsion system is not ready to operate, the indication 499 blinks. The lamp in the indication 499 is extinguished once the stop sequence has been completed.

The "Propulsion Failure" indication 500 appears with a red continuous light when the drive control identifies a failure within the propulsion system.

Those push buttons and indications/displays which are used for selecting and indicating the emergency control station are arranged in the "Control" area 500.

When the "Lamp Test" push button 501 is operated, all the lamps in the appropriate drive illuminate on the appropriate pendulum of the input and output element, and the corresponding signal horn is activated.

The "Alarm Reset" push button 502 allows existing alarms to be reset. Existing alarms are in this case indicated by blinking.

The horn is actuated when a control station changeover takes place and in order to produce alarms in response to spring situations. The use of the horn for alarms is enabled only when the emergency control station (ECS) is selected.

As illustrated in FIG. 9, an emergency stop push button 502 is provided for each drive. The emergency stop is independent of the active control station. When emergency stop is selected, the appropriate push button 503 illuminates.

For all the push buttons which initiate or control those functions which relate to both drives, such as control station changeover or the propulsion mode, the corresponding control panels, as shown in FIGS. 7–10, on the input and output elements of the control stations for the drive and propulsion system are used both for port and for starboard.

The following push buttons on the input and output elements as shown in FIGS. 7–10 act jointly on both drives:

"Crash Stop" 429

"Single Mode" 422

"Tandem Mode" 423

"Joystick" 424

"Track Pilot" 425

"Speed Pilot" 426

"Bridge Control" 463

"ECR Control" 464

"Steering Wheel Control" 466 and

"Take Control" 467.

Various conditions must be satisfied in the drive and propulsion system to allow the start sequence to be carried out on the control stations:

the control levers on the active control station must be in the stop position.

No "Shut Down" criterium may be active.

The selected converters must be ready to be switched on.

The RCU must be ready to be switched on.

The cooling system must be switched to automatic, under reference value must be below the selected limit value.

At least two generators must be connected to the on-board power supply network.

The start sequence is blocked when the "Start Block" lamp 457 is illuminated with a continuous light.

The start sequences activated by the "Start Propulsion" push button 459 on the active control station. In this case, the start sequence that is used is as follows:

1. Switch the cooling system from the emergency mode to the propulsion mode.
2. Release the shaft brakes
3. Start the hydraulic pump
4. Switch on the selected converters with a time delay.

During the start sequence, the "Start Propulsion" lamp in the push button 459 blinks at a low frequency. After correct completion, the lamp in the push button 459 is extinguished, and the green "Propulsion Ready" lamp illuminates. The drive and propulsion system is thus ready to operate. If the start sequence is interrupted by a fault, the "Start Fail" lamp 453 illuminates.

If the start sequence is started from the emergency control station shown in FIG. 9, the hydraulic pumps are not started automatically, and the shaft brake is not released automatically. This must be done in advance by the operator using the emergency control station push buttons for azimuth control.

To switch the system off, the control lever must be moved to the stop position. The steps in the start sequence are carried out in the opposite sense and in the opposite sequence during the stop sequence.

1. Nominal value zero for the converters
2. Switch off the converters
3. Apply the brake
4. Switch the cooling system from the propulsion mode to the emergency mode.

During the stop sequence, the "STOP Propulsion" lamp 460 blinks at a low frequency. Once the first step has been completed, the "Propulsion Ready" lamp changes to a continuous light. The system is now no longer ready to operate, and all the systems are switched off. If the stop sequence is interrupted by a fault, the "STOP Propulsion" lamp is extinguished.

If the stop sequence is started from the emergency control station shown in FIG. 9, the hydraulic pumps are not stopped automatically, and the shaft brake is not applied. This must be done by the operator as an additional item using the emergency control station push buttons for azimuth control, after stopping the drive. The crash stop sequence automatically carries out the following steps:

1. Request to the power management to start all generators.
2. Rotation speed nominal value is set to zero.
3. Torque limit is set to approximately 10%.
4. The second hydraulic pump is started in order to change the thrust direction more quickly.
5. Start to rotate both drives in opposite directions through 180°.
6. When the drive position is at approximately 75°, the rotation speed nominal value is set to the rated rotation speed.
7. The torque limit is gradually reduced from the 75° drive position to the 180° drive position.
8. At the 180° drive position, the rotation speed nominal value is at the rated rotation speed, and the torque limit is at the rated torque.

As long as the crash stop function is active, the lamp illuminates with a continuous light.

During a crash stop, the control levers on the control station on the bridge of the ship are readjusted.

The crash stop is ended by once again operating the crash stop push button on one of the input and output elements on the control device. After completion of the crash stop function, the SSP remains in its current position, and the rotation speed nominal value is set to zero. Once the crash stop has been completed, the propulsion system is reset to the "Harbor and Sea Mode". The active control lever assumes command again only once it has been moved to the zero position.

The appropriate push buttons are used to change from the "Harbor Mode" to the "Sea Mode". If the ship reaches a speed that has not yet been determined when in the "Harbor Mode", an audible alarm and blinking of the "Sea Mode Push button" are used to notify the fact that it would be advantageous for the safety of the ship to change to the "Sea Mode" now. In the sea mode, one hydraulic pump runs for each drive, and the control angle of the SSP is preferably limited to a maximum of ±35°.

In the "Harbor Mode" the drive can be rotated without any 360° limit, and two hydraulic pumps are in operation. In addition, the "Harbor Mode" is signaled to the "Power Management". When in the "Harbor Mode", the power management allows all the active generators to be connected to the network, irrespective of the power not being used.

As already explained in conjunction with FIG. 6, the control station changes are carried out without any sudden changes in the nominal values. There is no need to move the control levers to the same positions manually, since the control levers on the control station on the bridge of the ship are readjusted and the push buttons on the other control stations, in particular the emergency control stations, are themselves controlled. If the active control station is that on the bridge, the nominal values for the rotation speed and thrust direction are preset on the control station on the bridge. When the control station in the engine room (ECR) is active, only the rotation speed is preset from the ECR control station. The thrust direction is preset using the control station on the bridge. When the emergency control station is active, the nominal values for the thrust and thrust direction are preset jointly by means of push buttons on the emergency control station, as already explained above. The command preset by means of the control station on the bridge is carried out by means of a telephone for the thrust direction and thrust, and by means of the emergency telegraph that is installed, for the thrust.

Control station changes are initiated by pushing the "Bridge Control" push button on the central control station on the bridge. The initiation of the change is indicated by means of a blinking indication from the "Bridge Control" and "Take Control" lamps on the input and output elements on the control station on the bridge of the ship. Until the change in the control station has been confirmed by means of the "Take Control" push button, the change can be interrupted at any time by once again operating the "Bridge Control" push button. Pushing the "Take Control" push button results in an immediate change in the active control station, for example from that in the engine room (ECR) to the control station which has been switched to be active, for example that of the bridge. The change from the control station in the engine room to the control station on the bridge of the ship is signaled on the control station in the engine room by means of an audible alarm and by the "Bridge Control" lamp blinking. The fact that it is no longer the active control station is acknowledged by operating the "Bridge Control" push button on the control station in the engine room.

A change from the control station on the bridge to the control station in the engine room is initiated by pushing the "ECR Control" push button on the control station on the bridge. The initiation of the change is indicated by a blinking indication of the "ECR Control" lamp on the bridge control station and on the ECR control station. At the same time, an audible signal is produced simultaneously on both control stations to signal the initiation of the change. The "Take Control" push button blinks on the ECR control station. Until the change in the control station has been confirmed by the "Take Control" push button on the ECR station, the change can be interrupted at any time by once again operating the "ECR Control" push button on the bridge control station. Pressing the "Take Control" push button on the ECR control station results in the active control station being changed immediately from that on the bridge to the ECR control station. The "ECR control" lamp is illuminated with a continuous light on all the control stations. The "Bridge Control" lamp is extinguished on all the control stations, and the audible signaling is ended at all the control stations.

The change to the ECR control station is carried out by moving the "REM/ECS" selection switch from REM to ECS on the emergency control station. The switch gives the emergency control station control authority immediately. The "ECS Control" lamp on the emergency control station changes to a continuous light. the fact that the control station in the engine room (ECR control station) is no longer the active control station produces an alarm in the form of visual and audible signaling on the ECR control station input and output element (ECR panel). The "ECR Control" lamp on the ECR panel is extinguished. The "ECS Control" lamp on the ECR panel blinks until the fact that it is no longer the active control station has been acknowledged using the "ECS Control" push button on the ECR panel. The audible signal is also ended by the acknowledgment. The "ECS Control" lamp on the ECR panel has a continuous light. The "ECS Control" lamp on the bridge control station appears with a continuous light, and the "ECS Control" lamp is extinguished.

The fact that the control station on the bridge is no longer the active control station is signaled in the form of a visual and audible alarm on the input and output elements on the control station on the bridge. The "Bridge Control" lamp on the input and output element of the bridge control station is extinguished. The "ECS Control" lamp on the input and output elements on the bridge control station blinks until the fact that it is no longer the active control station has been acknowledged using the "ECS Control" push button on the bridge control station. The acknowledgment also ends the audible signaling. The "ECS Control" lamp on the bridge control station has a continuous light. The "ECS Control" lamp appears with a continuous light on the ECR control station, and the "Bridge Control" lamp is extinguished.

The change from the emergency control station to what is referred to as a remote control station is carried out by moving the "REM/ECS" selection switch from ECS to REM on the emergency control station. When changing from an emergency control station to a remote control station, the control stations on the bridge and in the engine room (ECR) are selected at the same time. The "Bridge Control" lamp blinks on the bridge, and an audible alarm is produced. The "ECR Control" lamp on the ECR control station blinks, and the horn is likewise sounded. When transferring control using the bridge control station, by operating the "Bridge Control" push button on the input and output elements on the bridge control station, the "Bridge Control" lamp changes to a continuous light, and the horn is turned off. The bridge control station now has command. On the ECR control station, the blinking "ECR Control" lamp is extinguished, and the "Bridge Control" lamp comes on. The horn is likewise turned off. If the ECR control station takes over control by operation of the "ECR Control" push button on the input and output elements on the ECR control station, the "ECR Control" lamp changes to a continuous light, and the horn is turned off. The ECR control station thus has command. The blinking "Bridge Control" lamp on the bridge control station is extinguished, and the "ECR Control" lamp comes on. The horn is likewise turned off.

A change between the control stations on the bridge of the ship is made by operating the "Take Control" push button on the desired control station. This can be done only when the active control station is on the bridge.

A reduction request is signaled when the following events occur:

- Winding temperature of the transformer has reached the limit for the reduction request.
- Winding temperature of the motor has reached the limit for the reduction request.

Temperature of the converter cooling water has reached the limit for the reduction request.

Temperature of the converter has reached the limit for the reduction request.

If the reduction request is ignored, and the values change such that they deteriorate further, an automatic reduction is initiated. This is done when the following events occur:

Winding temperature of the transformer has reached the limit for the automatic reduction.

Winding temperature of the motor has reached the limit for the automatic reduction.

Temperature of the converter cooling water has reached the limit for the automatic reduction.

Temperature of the converter has reached the limit for the automatic reduction.

In addition to said events, an automatic reduction is signaled when, during double converter operation, one converter is switched off for the following reasons:

internal fault in a converter ground short converter overtemperature transformer overtemperature cooling system overtemperature TCUVIII failure During the subsequent automatic reduction, it is possible to end the reduction process by means of an override:

reduction owing to the winding temperature of the transformer reduction owing to the winding temperature of the motor reduction owing to the temperature of the converter cooling water reduction owing to the temperature of the converter If the rotation speed actual value of the system has been forced below the rotation speed nominal value as a result of an automatic reduction, the override function becomes active only if a nominal value that is less than or equal to the actual value has been preset.

The override function can be ended at any time by the operator, by once again operating the slowdown override push button.

The override is signaled to the alarm system.

The request to stop is produced when the following events occur:

failure of both hydraulic pumps for azimuth control

An automatic stop is initiated when the following events occur:

motor limit temperature reached water enters the SSP pod to an extent that cannot be coped with by the bilge pumps short circuit failure of both converters converter cooling water reference value above the limit failure of the selected PSU (rotation speed regulator)

If a shutdown is carried out as a result of water ingress, the following sequence is initiated:

1. Rotation speed nominal value=0.
2. Operation of two hydraulic pumps.
3. Pivot the drive to 90°. Apply the shaft brake as soon as the rotation speed limit is reached.
4. Converter is switched off as soon as the shaft brake has been applied.
5. Nitrogen seal on the shaft is inflated (pneumatic stop).
6. Pivot the drive back to the control lever position.
7. Hydraulic pumps are switched as appropriate for the selected propulsion mode.

When carrying out a shutdown as a result of a short circuit, the following sequence is initiated:

1. Both converters are switched off.
2. Operation of two hydraulic pumps.
3. Pivot the drive to 90°. Apply the shaft brake as soon as the rotation speed limit is reached.
4. Pivot the drive back to the control lever position.
5. Hydraulic pumps are switched as appropriate for the selected propulsion mode.

For the "Ship has priority over the engine" function, it is possible to override the shutdown. Shutdowns which offer this capability are notified. The "Shutdown"and "Shutdown Override" lamps blink in order to notify this. The operator can decide, within 30 seconds, whether he wishes to allow this shutdown. Once the 30 seconds have elapsed, the shutdown is carried out. If he operates the override push button within 30 seconds, the shutdown is not carried out. By operating the override function, the operator must accept possible damage to the drive system.

The following shutdowns can be prevented:

motor limit temperature reached.

Water ingress in the SSP pod which cannot be coped with by bilge pumps.

The override is signaled to the alarm system.

The cooling system for converters has three operating modes.

The first operating mode is the switched-off state. This state is reached when the pump starter is switched from "automatic" to "manual".

During manual operation, the pumps are switched off by the Operator when necessary.

The second operating mode is the emergency mode. The emergency mode is activated by switching the pump starter from manual to automatic operation. The emergency mode for the cooling system is active when the propulsion system is switched off (" PROP. STOP" active). In the emergency mode, the pumps for the cooling system are started at intervals, in order to keep the reference value of the cooling water at a value which allows the propulsion system to be started immediately.

The third operating mode is operation when the propulsion system is activated. In this operating mode, one of the two cooling water pumps is operated continuously. The other pump is used as a emergency pump. The emergency stop can be initiated from the following locations:

bridge

ECC port wing starboard wing

ECR converter control cabinet

ECS emergency control station

Each SSP drive can be stopped individually by means of the emergency stop chain associated with it.

When emergency stop is activated, all the converters for the associated drive are switched off immediately, and the circuit breakers in the switchgear assembly are opened. The drive is disconnected.

Every emergency stop is carried out in the form of a latching switch. Switches at have been operated are represented by blinking signaling.

If a fault means that it is not possible to preset the nominal values using the control levers, then the operator can switch to emergency push button control.

The "Rotate the SSP to port and starboard" push buttons are arranged under he SSP position displays. The rotation direction is made clear by means of arrows.

In order to activate the push buttons that have just been mentioned, the emergency push button control must be activated. The "Emergency Steer" push button must be operated for activation. The activated emergency push button control is indicated by a continuous light.

All the emergency control push buttons are connected in parallel on the wings and on the center control station.

During emergency control operation, what is referred to as time control is active. Signals from the and push buttons are passed directly to the valves for the control hydraulics.

If a fault means that it is impossible to use the control levers to preset the rotation speed nominal values, then the operator can switch to emergency push button control.

The "Raised rotation speed" and "Reduced rotation speed" push buttons are arranged under the SSP rotation speed indications. The commands are made clear by arrows.

Emergency push button control must be activated in order to active the push buttons that have just been mentioned. The "Emergency Speed Control" push button must be operated for activation. The activated emergency push button control is indicated by means of a continuous light.

All the emergency control push buttons are connected in parallel on the wings and on the center control station.

During emergency control operation, what is referred to as time control is active. Signals from the and push buttons are passed directly to the inputs to the assembly for rotation speed control.

Although modifications and changes may be suggested by those skilled in the art to which this invention pertains, it is the intention of the inventors to embody within the patent warranted hereon all changes and modifications that may reasonably and properly come under the scope of their contribution to the art.

What is claimed is:

1. A drive and propulsion system for a ship, comprising: at least one steering propeller arranged outboard and having a rotatable azimuth module and a power transmission device, and a propulsion module arranged as a pod on the azimuth module having a drive motor for the propeller, the drive motor being in the form of a permanent magnetic synchronous machine with a stator winding having at least three sections connected to a 3-phase alternating current source and connected via the power transmission device to a converter arranged in the ship and connected on an input side via converter transformers to a ship's on-board power supply system, whereby a digital control and regulation device comprising standardized assemblies in a modular form being provided for each steering propeller.

2. The drive and propulsion system of claim 1, further comprising subsystems including one or more regulation and control devices operable in parallel, wherein one of the regulation and control devices can be used as a master, and the another can be used as a slave.

3. The drive and propulsion system claim 2, wherein each subsystem has an associated programmable safety device which, produces regulation and control signals and alarm signals automatically.

4. The drive and propulsion system of claim 3, wherein each converter has phase current regulation.

5. The drive and propulsion system of claim 4, wherein the phase current regulation is preceded by field-oriented regulation in the form of transvector control.

6. The drive and propulsion system of claim 5, further comprising a monitoring device, whereby power generation and distribution in an on-board power supply network can be protected against being overloaded by the drive motor.

7. The drive and propulsion system of claim 6, herein individual components of the system are arranged in at least one prefabricated container.

8. The drive and propulsion system of claim 7, wherein the dimensions of the at least one prefabricated container are standardized.

9. The drive and propulsion system of claim 8, further comprising a device for remote position monitoring arranged on the at least one prefabricated container.

10. The drive and propulsion system of claim 9, wherein the device for remote position monitoring is a GPS unit.

11. The drive and propulsion system of claim 10, wherein the device for remote position monitoring is removable.

12. The drive and propulsion system of claim 1, wherein the regulation device has only a single rotation speed regulator, regardless of the number of motors operating on one shaft, the regulation device dampens oscillations in a drive whose rotation speed is regulated, with the output signal from the rotation speed regulator being fed back to its regulator input.

13. The drive and propulsion system of claim 12 wherein the fed back output signal is inverted.

14. The drive and propulsion system of claim 13, wherein the fed back output signal is multiplied by a factor.

15. The drive and propulsion system of claims 14, wherein the multiplication factor is set such that it results in a steady-state control error of about 0.2% to 1.5% at the rated load.

16. The drive and propulsion system as claimed in claim 15, wherein the steady-state control error is compensated for by a corrected nominal value n*.

17. The drive and propulsion system of claim 16, wherein the nominal value compensation $n_L$* is carried out as a function of the estimated load.

18. The drive and propulsion system of claim 17, wherein the load is determined on the basis of a characteristic from the non-compensated rotation speed nominal value or from the rotation speed actual value.

19. The drive and propulsion system of claim 18, wherein the regulation device further comprises a rotation speed regulator whose output value makes it possible to preset a torque nominal value or current nominal value via a converter for an electrical propeller motor or the ship propeller, whereby the electrical propeller motor is supplied with electrical power from an on-board power supply network via a converter, which is supplied with electrical power by a diesel generator system, in accordance with a torque nominal value or current nominal value corresponding to the nominal rotation speed of the rotation speed regulator provided by an adaptive ramp transmitter, so that time matching of the current nominal value of a current regulator of the converter to the current nominal value corresponding to the nominal rotation speed present at the rotation speed regulator, can be controlled based upon limit values predetermined by the on-board power supply network and/or by the diesel generator system which feeds the on-board power supply network with electrical power.

20. The drive and propulsion system of claim 19, wherein a run-up time and a run-down time of the adaptive ramp transmitter can be varied in proportion to the magnitude of the actual rotation speed of the electric propeller motor.

21. The drive and propulsion system of claim 20, wherein a minimum run-up time and a minimum run-down time can be predetermined for the run-up time and the run-down time of the adaptive ramp transmitter for the current nominal value of the current regulator in a lower rotation speed range of the electric propeller motor, or of the ship's propeller, such that the minimum run-up time and minimum-run-down time are dependent on the maximum permissible rate of change of a wattless component emitted by synchronous generators in the diesel generator system which feeds the on-board power supply network.

22. The drive and propulsion system of claim 21, wherein the regulation device further comprises a rotation speed regulator associated with the electric propeller motor, whose output signal, the torque nominal value or the current nominal value, regulates the rotation speed of the electric propeller motor via a converter, and a ramp transmitter, into which a rotation speed nominal value for the electric propeller motor can be entered and predetermined for the rotation speed regulator via a rotation speed nominal value profile, by which the actual rotation speed of the electric propeller motor can be matched to the rotation speed nominal value entered in the ramp transmitter for the electric propeller motor, whereby the ramp transmitter is in the form of an adaptive ramp transmitter having a characteristic transmitter which can be controlled by the magnitude of the rotation speed actual value of the electric propeller motor.

23. The drive and propulsion system of claim 22, whereby different dependency levels between the actual rotation speed of the electric propeller motor and the run-up time can be predetermined in the characteristic transmitter of the adaptive ramp transmitter for different actual rotation speed ranges of the electric propeller motor.

24. The drive and propulsion system of claim 23, wherein a dependency level between the actual rotation speed of the electric propeller motor and the run-up time can be set continuously in at least one higher actual rotation speed range of the electric propeller motor.

25. The drive and propulsion system of claim 1, wherein the control device comprises at least one control station with input and output elements for selecting, visualizing and activating operating modes, whereby control station switching operations and/or operating mode changes can be activated via the input and output elements.

26. The drive and propulsion system of claim 25, wherein the input and output elements comprise switching selection push buttons.

27. The drive and propulsion system of claim 26, wherein the input and output elements comprise lamps, combined with the switching selection pushbuttons.

28. The drive and propulsion system of claim 27, wherein the input and output elements comprise at least one text display indication having a resolution of 4 lines, with 20 characters in each line.

29. The drive and propulsion system of claim 28, wherein fault and/or defect messages can be displayed on the text display indications.

30. The drive and propulsion system of claim 29, wherein the control device comprises at least one input and output element which can be used as an emergency controller directly connected to the drive motors, to the azimuth modules and to the propulsion modules in order to control them.

31. The drive and propulsion system of claim 30, wherein the at least one input and output element is in the form of an emergency control station.

32. The drive and propulsion system of claim 31, wherein the control device, the regulation device, the drive motors, the azimuth module and the propulsion module are connected to one another for communication via a bus system.

33. The drive and propulsion system of claim 32, which has a plurality of control stations and wherein the control stations, the assemblies and the modules are connected to one another via the bus system interchange state values via the bus system, with value checks being carried out in dialogue form.

34. The drive and propulsion system of claim 33, wherein the at least one emergency control station is provided in the stern half of the ship.

35. The drive and propulsion system of claim 32, wherein the bus system is a ring bus.

* * * * *